US005784082A

United States Patent [19]

Shinmachi et al.

[11] Patent Number: 5,784,082

[45] Date of Patent: Jul. 21, 1998

[54] INFORMATION PROCESSING APPARATUS, AND HEAD MEMBER MOUNTABLE ON SUCH INFORMATION PROCESSING APPARATUS

[75] Inventors: Masaya Shinmachi, Kawasaki; Tetsuo Suzuki, Yokohama; Masahiro Taniguro, Ushiku; Hiroyuki Saito, Yokohama; Koichi Tanno, Kawasaki; Haruyuki Yanagi, Machida; Makoto Kawarama, Kawasaki; Hiroyuki Kinoshita, Kawasaki; Tan At Ming, Kawasaki, all of Japan

[73] Assignee: Canon Kabushiki Kaisha, Tokyo, Japan

[21] Appl. No.: 509,945

[22] Filed: Aug. 1, 1995

[30] Foreign Application Priority Data

| | | | |
|---|---|---|---|
| Aug. 4, 1994 | [JP] | Japan | 6-183678 |
| Aug. 4, 1994 | [JP] | Japan | 6-183680 |
| Jul. 26, 1995 | [JP] | Japan | 7-190302 |

[51] Int. Cl.[6] ..... B41J 2/14

[52] U.S. Cl. ..... 347/49

[58] Field of Search ..... 347/49, 50, 37, 347/87

[56] References Cited

U.S. PATENT DOCUMENTS

| | | | |
|---|---|---|---|
| 5,392,063 | 2/1995 | Rhaods | 347/49 |
| 5,646,665 | 7/1997 | Swanson et al. | 347/87 |

FOREIGN PATENT DOCUMENTS

| | | |
|---|---|---|
| 0590669 | 4/1994 | European Pat. Off. . |
| 0602020 | 6/1994 | European Pat. Off. . |
| 0650847 | 5/1995 | European Pat. Off. . |
| 4206119 | 7/1992 | Japan . |

OTHER PUBLICATIONS

Dangelo, et al., "Print Cartridge Fixturing and Maintenance in the HP DeskJet 1200C Printer", *Hewlett-Packard Journal*, vol. 45, No. 1, pp. 67–71, Feb. 1994.

*Primary Examiner*—Adolf Berhane
*Assistant Examiner*—Gregory J. Toatley, Jr.
*Attorney, Agent, or Firm*—Fitzpatrick, Cella, Harper & Scinto

[57] ABSTRACT

An information processing apparatus for executing information processing on a sheet material using a head member arranged for information processing area comprises a head mounting member for mounting a head member thereon, this head mounting member having a position for attaching and detaching the head member to and from the head mounting member, and a mounting position to mount the head member on the head mounting member by positioning the head member with respect to the head mounting member; a pressing member movably arranged on the head mounting member, this pressing member abutting upon the head member mounted on the head mounting member to cause the head member to shift from the attaching and detaching position to the mounting position by the application of pressure given to the head member; and a contact area for the pressing member and head member to abut upon each other, this contact area being arranged to reduce slide resistance to occur in the direction different from the direction in which the head member shifts from the attaching and detaching position to the mounting position. With this structure, the slide resistance to be exerted between these members, which may produce adverse effect on positioning the head member, is made extremely small in order to reliably position the head member exactly.

26 Claims, 21 Drawing Sheets

FIG. 13B
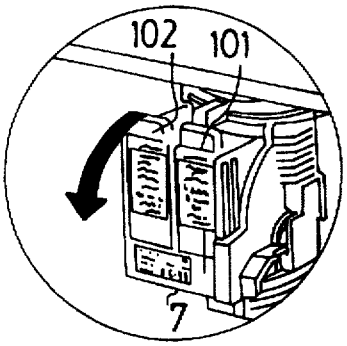
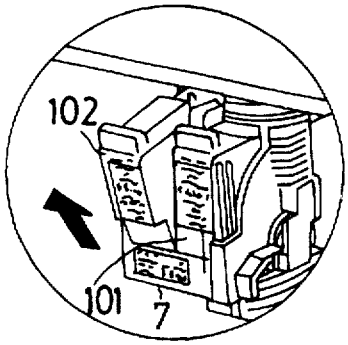
FIG. 13C
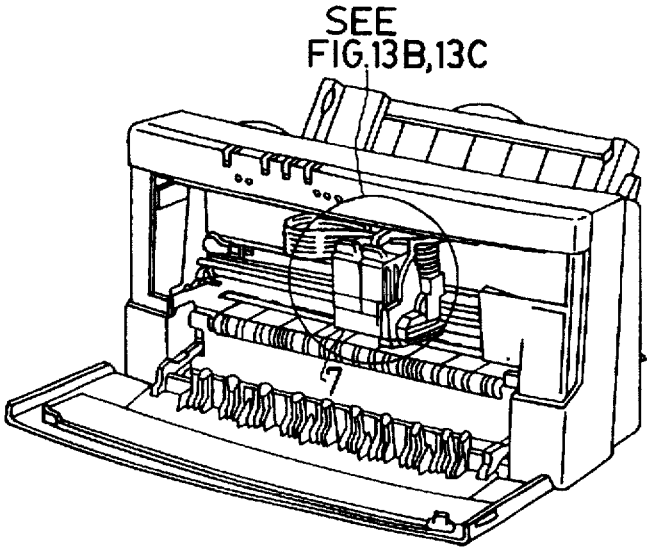
FIG. 13A
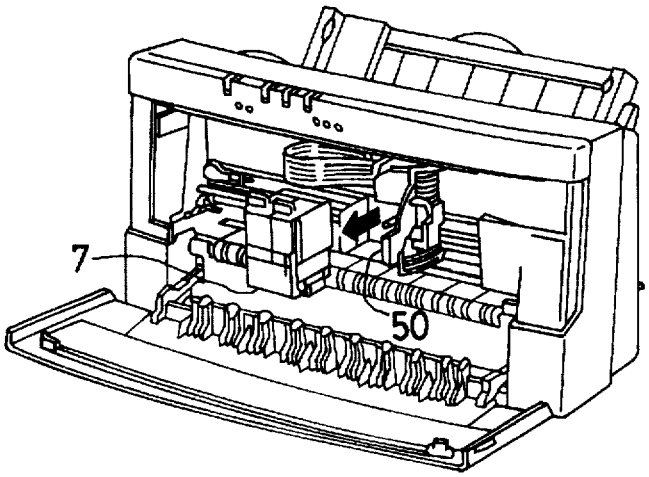
FIG. 14

INFORMATION PROCESSING APPARATUS, AND HEAD MEMBER MOUNTABLE ON SUCH INFORMATION PROCESSING APPARATUS

BACKGROUND OF THE INVENTION

1. Field of the Invention

The present invention relates to an information processing apparatus provided with a head mounting unit for mounting a head member, and a head member mountable on such information processing apparatus. More particularly, the invention relates to an information processing apparatus provided with a head mounting unit capable of mounting a head member on it, accompanying its electrical connection, and relates to a head member mountable on such information processing apparatus.

2. Related Background Art

A recording apparatus having the function of a printer, copying machine, facsimile apparatus and the like or a recording apparatus used as the output equipment for a complex electronic equipment including a computer, a wordprocessor or the like, or the output equipment for a work station, is structured to record images on a recording material (recording medium), such as a recording sheet or a thin plastic sheet, in accordance with image information. These recording apparatuses are divided into those using ink jet, wire dot, thermal, laser beam, and others by the kinds of recording methods adopted.

Of the recording apparatus described above, the one using the ink jet method (an ink jet recording apparatus) is to record by discharging ink from recording means (recording head) to a recording material, and to enable the compact fabrication of recording means to record images in high precision at high speeds and low running costs. Also, this apparatus produces less noises because it is nonimpact type, and presents various other advantages including the ease with which color images can be recorded by use of multicolor ink. Particularly, it is possible to perform recording at higher speeds by use of a line type recording means for a line type recording apparatus, which is provided with many numbers of discharging ports arranged in the width direction of recording sheet.

As the background art of the present invention, the inventor et al hereof have filed Japanese Patent Application No. 6-183481 for a method of mounting on a recording apparatus a recording head of a serial type or a recording head of a full line type as described in the preceding paragraph.

As shown in FIGS. 22A and 22B, this method is to mount a recording head 7 (see FIGS. 23A to 23D) on a head holder 51 from the front side of a carriage 50. Then, the recording head 7 is caused to shift to the right side together with the head holder 51 when placing a hook lever 53 downward. In this state, the recording head 7 is positioned and its electrical contact becomes possible. For the side plate 502 of the carriage 50, two fitting pins (not shown) are provided for the corresponding fitting holds *77a* and *77b* of the recording head 7 in order to position the recording head 7. When the contact surface 78 of the recording head 7 abuts upon the contact surface 503 of the flexible board 56 mounted on the carriage 50, electric signals are transmitted to or received from the recording head 7 to effectuate the formation of images. Also, for the recording head 7, an ink tank is integrally prepared to retain ink to form images.

As described above, the recording head is caused to shift in the head mounting unit to a position to set the electrical connection after it is inserted into the head mounting unit, and then, the recording head is exactly positioned and fixed. Here, the recording head is pressed by an extruded pressure portion of the head mounting unit in the direction of shift (to the contact position where the extruded pressure unit and the side face of the recording head abut upon each other). However, as shown in FIG. 24A (an enlarged view schematically showing the head mounting unit observed from the above in order to represent the positional relationship between the respective parts), if the recording head is inserted into the head mounting unit with an inclination to the direction of shift, its position may be displaced to a position from the normal position B. Usually, there is a slight play provided for mounting the recording head when it is inserted into the head mounting unit. As a result, it is inevitable that such a state as shown in FIG. 24A presents itself more or less when the recording head is inserted. Then, after that, it is positioned normally as shown in FIG. 24B as the recording head is pressed by means of the pressure portion to shift in the head mounting unit. Therefore, during this shifting period, such position of the side face of the recording head that abuts upon the pressing unit moves from the point A to the point B, hence exerting slide resistance force (friction) in the direction perpendicular to the direction of pressure between the extruded pressure unit and the portion of the side face of the recording head to be pressed during this period. The resistance force thus exerted often causes scratches or other damages on the extruded pressure unit and the side face of the recording head. Then there is a possibility that the positioning of the recording head is hindered to make it difficult to execute any normal positioning of the recording head reliably.

Now, assuming that the portion of the head mounting unit to press the side face of the recording head is not configured as the extruded pressure unit as described above, but as a flat unit, and that the side face of the recording head is pressed by the surface of such flat unit, the position to be pressed is displaced from the point A to the point B eventually as in the previous case, hence also exerting slide resistance force because the point A in FIGS. 24A and 24B are positioned at the corner of the edge portion of the side face of the recording head, while the point B is positioned on the entire side face of the recording head at the same time.

Therefore, the recording head and the recording apparatus described above are subjected to the occurrence of malfunction in executing recording operation due to the improper electrical connection if the recording head is not positioned exactly in its normal position.

SUMMARY OF THE INVENTION

It is an object of the present invention to provide an information processing apparatus capable of mounting a head member by positioning it in an appropriate position when mounting the head member on the information processing apparatus, and to provide a head member mountable on such information processing apparatus.

It is another object of the present invention to provide an information processing apparatus capable of obtaining a good electrical connection between the head mounting unit and a head member to be mounted on the head mounting unit, and a head member mountable on such information processing apparatus.

It is still another object of the present invention to provide an information processing apparatus to execute information processing on a sheet material using a head member arranged for information processing area, which includes:

a head mounting member to mount a head member on it, this head mounting member having a position for attaching and detaching the head member to and from the head mounting member, and a mounting position to mount the head member on the head mounting member by positioning the head member with respect to the head mounting member;

a pressing member movably arranged on the head mounting member, this pressing member abutting upon the head member mounted on the head mounting member to cause the head member to shift from the attaching and detaching position to the mounting position by pressing the head member; and a contact area for the pressing member and the head member to abut upon each other, this contact area being arranged to reduce slide resistance to occur in the direction different from the direction in which the head member shifts from the attaching and detaching position to the mounting position.

It is a further object of the present invention to provide a recording apparatus having:

means for attaching and detaching a recording head to and from a given position in a recording head mounting unit for the formation of images on a recording medium;

means for positioning the recording head on the given position in a recording head mounting unit; and means for making electrical contact to transmit and receive electric signals to and from the recording head by abutting it upon the electrically contacting surface of the recording head mounted on the aforesaid given position. This apparatus is arranged to include in accordance with the present invention:

pressing means for pressing the recording head in a given direction to the side opposite to the aforesaid contacting means and positioning means; and a member for reducing slide resistance between the pressing member positioned with respect to the pressing direction of the pressing member, and the recording head.

It is still a further object of the present invention to provide a recording head for forming images on a recording medium, which is detachably mounted on a recording apparatus by attaching and detaching means using means for pressing the recording apparatus, and provided with means for positioning the recording head on a given mounting position in the recording apparatus, and means for making electrical contact to transmit and receive electrical signals to and from the recording apparatus, and this recording head being arranged to include the following:

means for receiving pressure to be exerted by the aforesaid pressing means of the recording apparatus on the side opposite to the surface of the aforesaid positioning and electrical contact, this means for receiving pressure being formed to reduce slide resistance to the recording apparatus in the plane direction substantially perpendicular to the direction of the aforesaid pressure.

BRIEF DESCRIPTION OF THE DRAWINGS

FIG. 13 is a perspective view which shows the external appearance of a recording apparatus in accordance with the present invention.

FIG. 14 is a view which shows the state where the recording head represented in FIG. 13 is being removed.

DETAILED DESCRIPTION OF THE PREFERRED EMBODIMENTS

Figure 1:
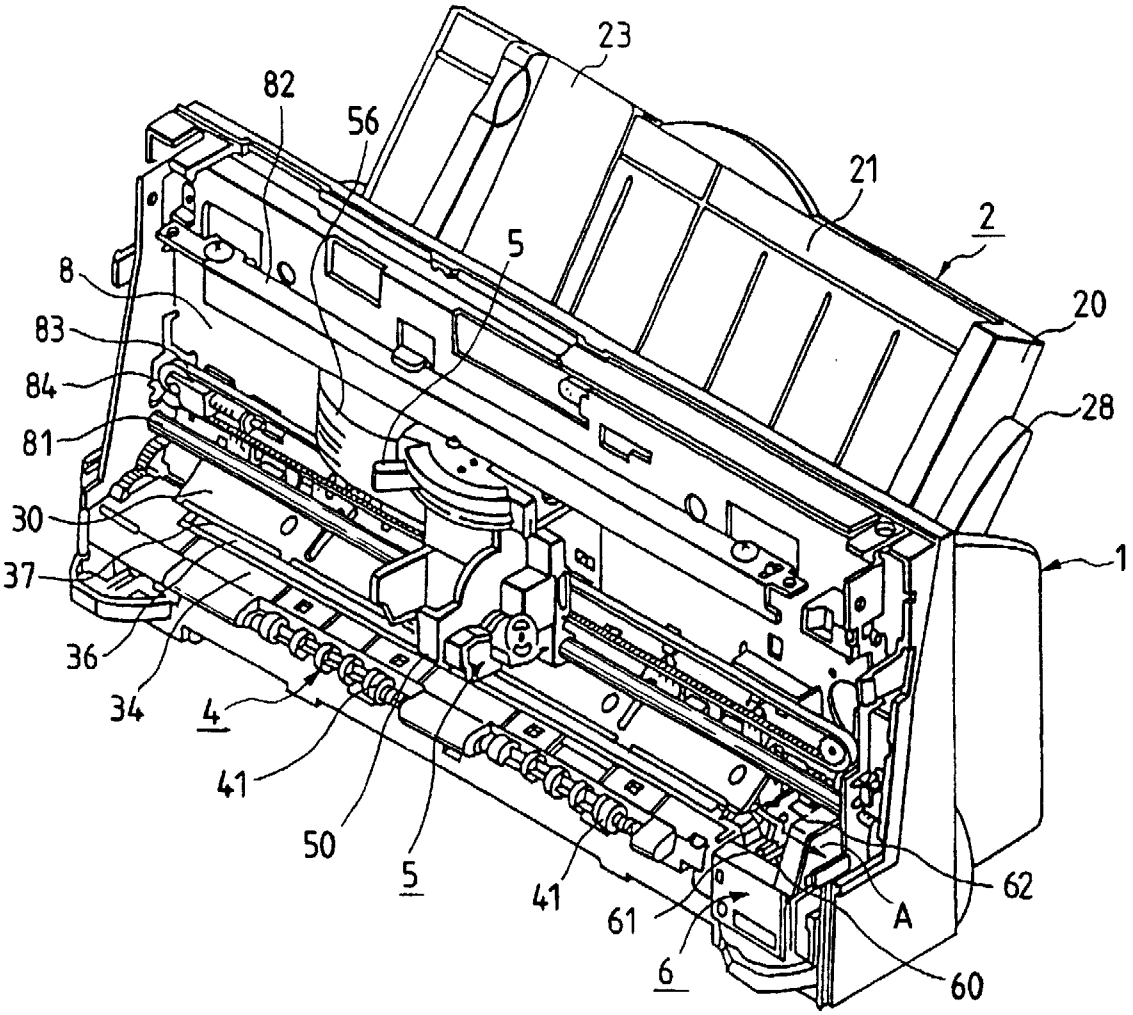
FIG. 1 is a perspective view which shows a first embodiment of a recording apparatus in accordance with the present invention.
Figure 2:
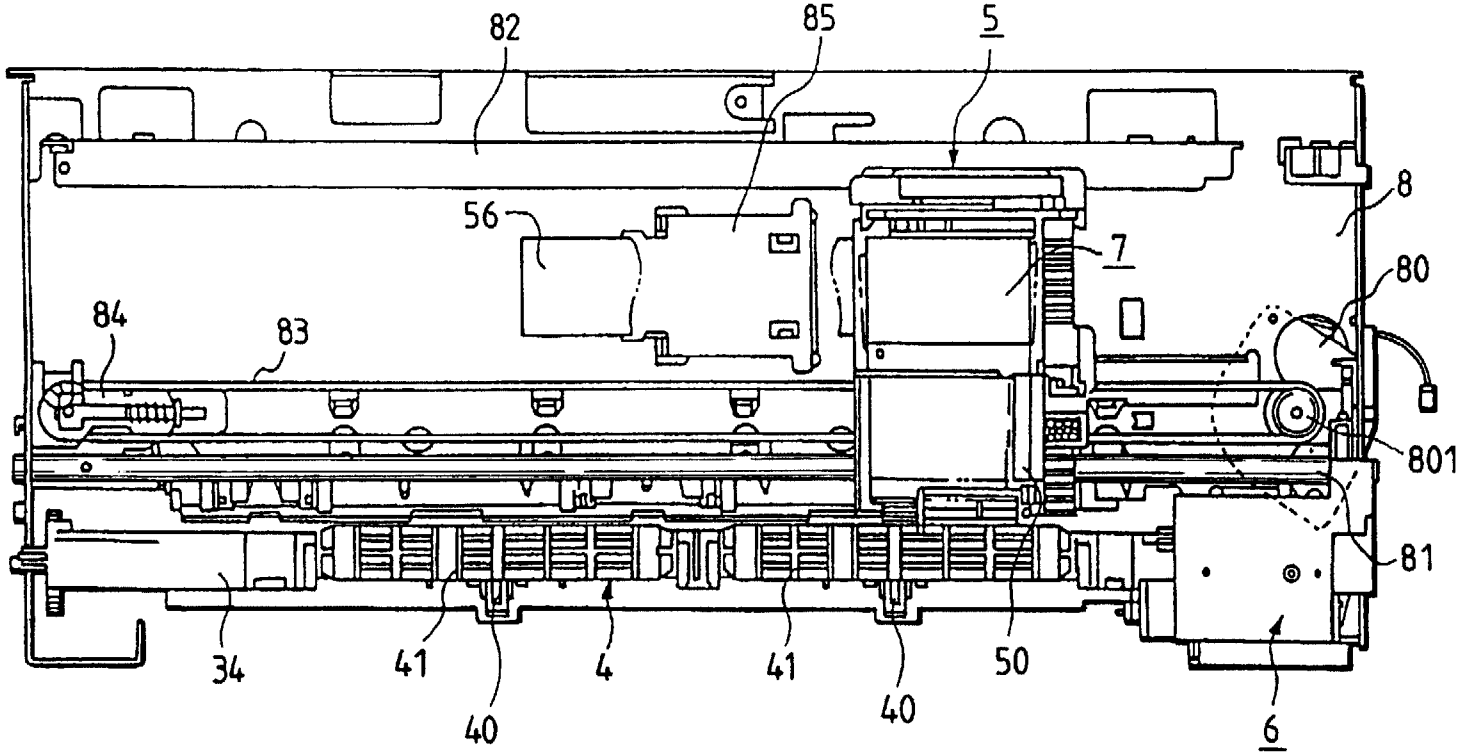
FIG. 2 is a front view of the recording apparatus represented in FIG. 1.

Hereinafter, with reference to the accompanying drawings, the description will be made of the embodiments in accordance with the present invention.

In this respect, the information processing apparatus to which the present invention is applicable is an information processing apparatus to execute reading processes or recording processes with respect to the sheet member arranged for an information processing area by means of a reading head or recording head mounted on the head mounting unit. It should be good enough if only the head mounting unit of this apparatus is in a mode that it is provided at least with an attaching and detaching position for detachably mounting the head member on the head mounting member, and a mounting position for positioning and mounting the head member on the head mounting unit, as well as with a contact area where the head member is in contact with the mounting position from the attaching and detaching position, and pressed to shift by means of the pressing member. Further, it should be more desirable if the electrical connection is made in the mounting position between the electrical connectors on the head member and head mounting unit sides at that time, because this makes it possible to carry out the electrical connection in a better condition.

Also, when an information processing apparatus uses a recording head as its head member, the mode of such recording head may be the one in which a recording head and an ink tank to supply ink to the recording head are integrally formed and mounted on the head mounting unit; a recording head formed separately from an ink tank and provided with an ink tank holder is mounted on the head mounting unit, at the same time, an ink tank being mounted on such ink tank holder; or only a recording head is mounted on the head mounting unit while an ink tank being arranged on the main body side of the recording apparatus. Further, a mounting mode may be such that an ink tank is being pressed to shift with respect to the recording head that has already been mounted on the head mounting unit, and then, it is positioned with respect to the recording head. Here, in either one of these cases, it is preferable to adopt the mode in which the electrical connection is made in the mounting position of the recording head between the electrical connectors on the recording head and head mounting unit sides because this makes it possible to obtain the electrical connection in a better condition.

First Embodiment

A first embodiment will be described in conjunction with FIG. 1 to FIG. 17E in accordance with the present invention. A recording apparatus 1 provided with an automatic sheet feeder comprises a sheet supply unit 2, a sheet feed unit 3, a sheet exhaust unit 4, a carriage unit 5, and a cleaning unit 6. Now, the brief description will be made in that order by items divided accordingly.

(A) Sheet Supply Unit

Figure 3:
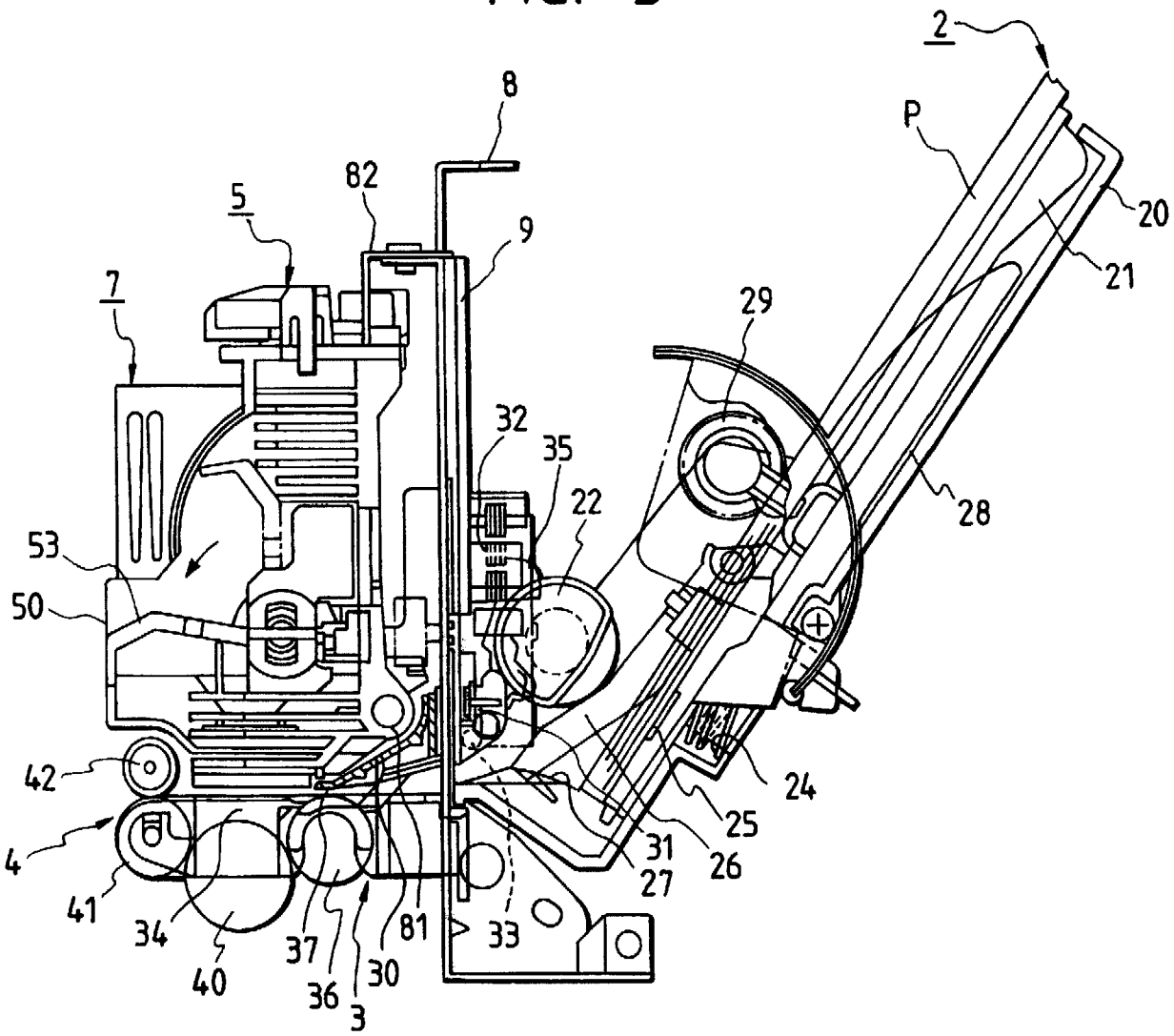
FIG. 3 is a cross-sectional view which shows the recording apparatus represented in FIG. 1.
Figure 4A:
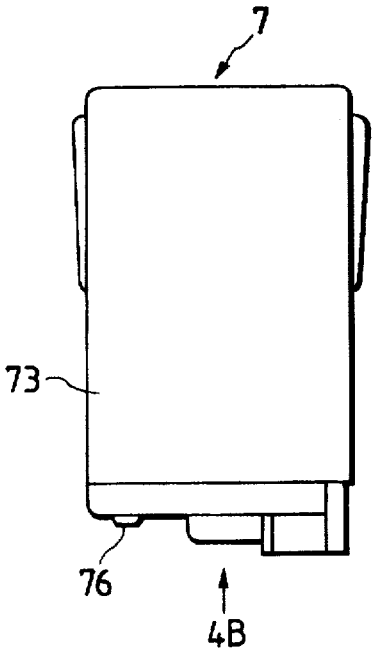
FIG. 4A is a front view which shows a recording head represented in FIG. 2.
Figure 4B:
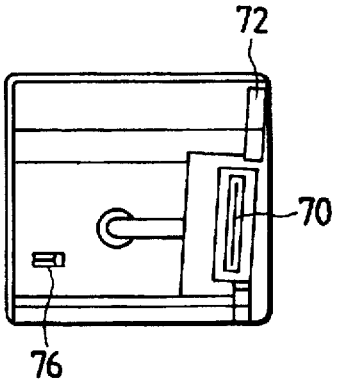
FIG. 4B is a view which shows the lower end of the recording head illustrated in FIG. 4A.
Figure 4C:
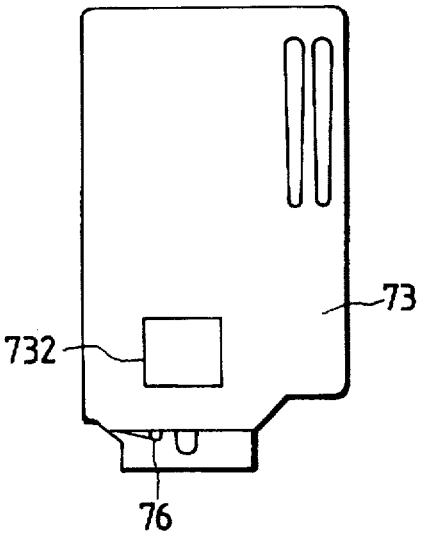
FIG. 4C is a side view which shows the left-hand side of the recording head illustrated in FIG. 4A.
Figure 4D:
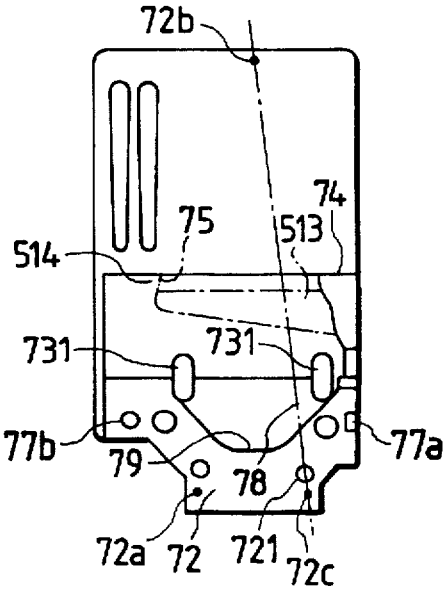
FIG. 4D is a side view which shows the right-hand side of the recording head illustrated in FIG. 4A.

As shown in FIG. 3, the sheet supply unit 2 is structured to fix to a base 20 (see FIG. 1) a pressure board 21 for stacking sheet materials P and a rotary element 22 for supplying and feeding sheet materials P. On the pressure board 21, a movable side guide 23 (FIG. 1) is movably mounted to regulate the stacking position of the sheet materials P. The pressure board 21 is rotational around the center of the rotary shaft coupled to the base 20, and biased to the supply and feed rotary element 22 by means of a pressure board spring 24. On the location where the supply and feed rotary element 22 and the pressure board 21 face each other, there is provided a separation pad 25 formed by a material having a large friction coefficient such as an artificial leather or the like in order to prevent the sheet materials P from being overlapped when each of them is supplied and fed. Further, on the base, there are arranged a separation nail 26 to cover the corners of the sheet material P in one direction and separate the recording sheets P one by one; a bank 27 integrally formed with the base 20 for separating the sheets for which the separation nail 26 cannot be used, such as a thick paper board or the like; a switching lever 28 to set the separation nail 26 so that it functions in a position for use of ordinary sheets or it does not function in a position for use of any thick paper board; and a release cam 29 for releasing the contact between the pressure board 21 and supply and feed rotary element 22.

In the structure described above, the release cam 29 presses down the pressure board 21 to a given position. Thus the contact between the pressure board 21 and the supply and feed rotary element 22 is released. The driving force is given to a feed roller 36 in this state and transmitted to the supply and feed rotary element 22 and the release cam 29 by means of gears and others. Then the release cam 29 is caused to part from the pressure board 21. The pressure board 21 ascends accordingly to enable the supply and feed rotary element 22 and sheet materials P to be in contact with each other. Each of the sheet materials P is picked up along the rotation of the supply and feed rotary element 22, thus starting its feed, and each of them being separated by means of the separation nail 26 and transferred to the sheet feeder 3 one by one. The supply and feed rotary element 22 and the release cam 29 rotate until the sheet material P is fed into the sheet feeder 3, and then, again on standby to release the contact between the recording sheet P and the supply and feed rotary element 22, thus suspending the transmission of the driving force from the feed roller 36.

(B) Sheet Feeder

As shown in FIG. 3, the sheet feeder 3 is provided with a feed roller 36 for feeding the sheet materials P and a PE sensor 32. To the feed roller 36, a pinch roller 37 that follows it is arranged to be in contact therewith. The pinch roller 37 is supported by a pinch roller guide 30 and is biased by means of a pinch roller spring 31. In this way, feeding force is exerted on the sheet materials P by causing the pinch roller 37 to abut upon the feed roller 36. Further, at the entrance of the sheet feeder 3 to which the sheet materials P are being carried, an upper guide 33 and a platen 34 are arranged in order to guide the sheet materials P. Also, on the upper guide 33, a PE sensor lever 35 is arranged to transmit the detection of the leading and trailing ends of each sheet material P to the PE sensor 32, respectively. Further, on the downstream side of the feed roller 36 in the feeding direction of the recording sheets, the recording head 7 is arranged to form images in accordance with image information.

With the structure described above, the sheet material P carried to the sheet feeder 3 is guided further by the platen 34, the pinch roller guide 30, and the upper guide to a roller pair formed by the feed roller 36 and the pinch roller 37. At this juncture, the PE sensor lever 35 detects the leading end of the sheet material thus carried and obtains the printing position for the sheet material P. Also, the sheet material P is fed on the platen 34 by the rotation of the roller pair 36 and 37 driven by a line feed motor (not shown).

Here, for the recording head 7, an ink jet recording head is used, which is integrally structured with an ink tank for an easier exchange of heads. The recording head 7 is capable of giving heat to ink by means of heaters or the like serving as electrothermal transducing elements. Then, by the heat thus generated, film boiling is generated in ink, and by changes of pressure caused by the development and contraction of air bubbles formed by means of the film boiling, ink is discharged from the nozzles 70 of the recording head 7 onto the sheet material P for the formation of images.

(C) Carriage Unit

Figure 7:
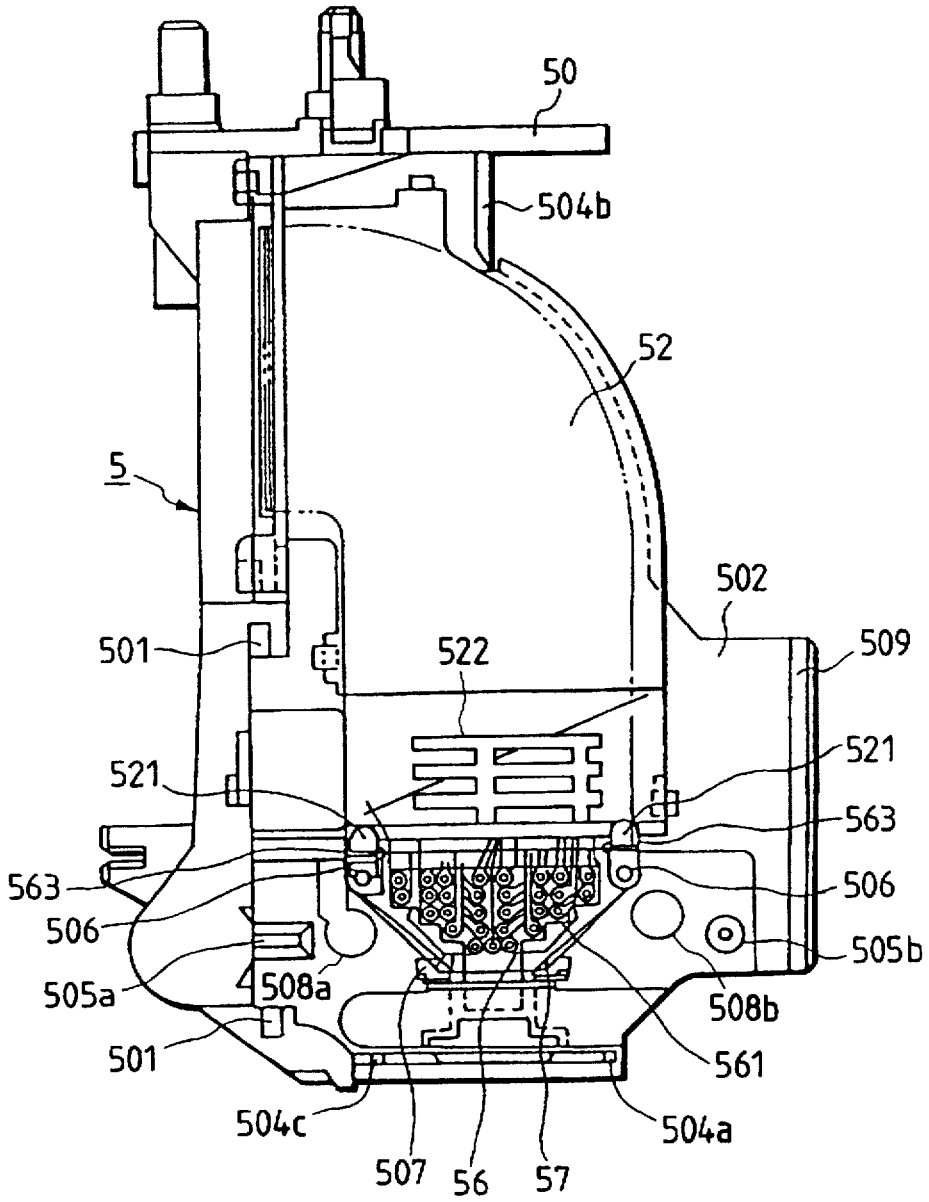
FIG. 7 is a view which shows the structure of the contacting portion of the carriage unit 5.

The carriage unit 5 is provided with a carriage 50 to mount the recording head 7 on it (see FIG. 7). Then the carriage 50 is supported by the guide shaft 81 that enables it to reciprocate in the direction at right angles to the feeding direction of sheet materials P, as well as the guide rail 82 that holds the rear end of the carriage 50 for the maintenance of a gap between the recording head 7 and the sheet material P. In this respect, the guide shaft 81 and the guide rail 82 are fixed to a chassis 8. Also, the carriage 50 is driven by a carriage motor 80 (see FIG. 2) fixed to the chassis 8 through a timing belt 83. The timing belt 83 is tensioned and supported by means of an idle pulley 84. Further, the carriage 50 is provided with a flexible board 56 for the transmission of head signals from an electric board 9 (see FIG. 3) to the recording head 7.

In the structure described above, when images are formed on sheet materials P, the roller pair 36 and 37 carries a sheet material P to the line position to form an image (a position in the feeding direction of the sheet material P), and at the same time, the carriage 50 is caused to shift to the column direction to form an image (a position perpendicular to the feeding direction of the sheet material P) by use of the carriage motor 80, thus allowing the recording head 7 to face a position to form an image. After that, the recording head 7 discharges ink to the sheet material P in accordance with signals from the electric board 9.

(D) Exhaust Unit

The exhaust unit 4 is arranged by a transfer roller 40 that abuts upon the feed roller 36, and then, the transfer roller 40 abuts upon an exhaust roller 41 (see FIG. 3). Therefore, the driving force exerted on the feed roller 36 is transferred to the exhaust roller 41 through the transfer roller 40. Also, a spur 42 abuts upon the exhaust roller 41 so that it can rotate following the rotation of the exhaust roller 41. With the structure described above, the sheet material P, on which images are formed by means of the carriage unit 5, is pinched and carried by the exhaust roller 41 and the spur 42, thus being exhausted onto an exhaust tray or the like (not shown).

(E) Cleaning Unit

The cleaning unit 6 comprises a pump 60 used for cleaning the recording head 7; a cap 61 (see FIG. 1) used to suppress the drying of the recording head 7; and a driving switching arm 62 for switching the driving force exerted by the feed roller 36 to the driving of the sheet supply unit 2 and the pump 60. The driving switching arm 62 (see FIG. 1) is arranged to fix the planetary gear (not shown), which is rotative around the axial center of the feed roller 36, to a given position unless it engages with sheet feeding or cleaning. In this way, the driving force is not transferred to the sheet supply unit 2 and the pump 60. When the carriage 50 shifts, the driving switching arm 62 moves in the direction indicated by an arrow A. Then the planetary gear becomes free and can shift itself in accordance with the regular or reverse rotation of the feed roller 36. When the feed roller rotates regularly, the driving force is transferred to the sheet supply unit 2, and then, to the pump 60 when the feed roller rotates reversely.

Now, the principal parts of the carriage unit 5 will be described in detail.

Figure 5B:
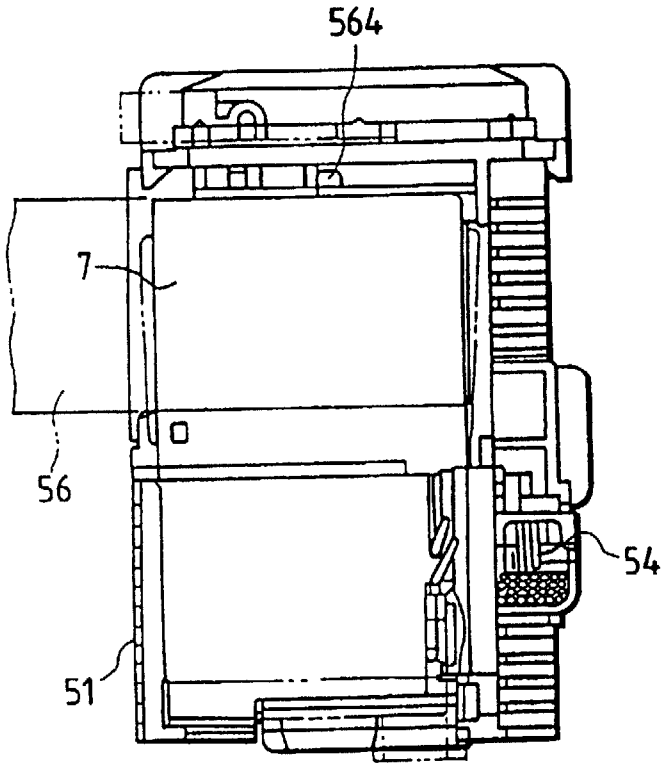
FIG. 5B is a front view which shows a contact spring 54 and others in the carriage unit 5.
Figure 5A:
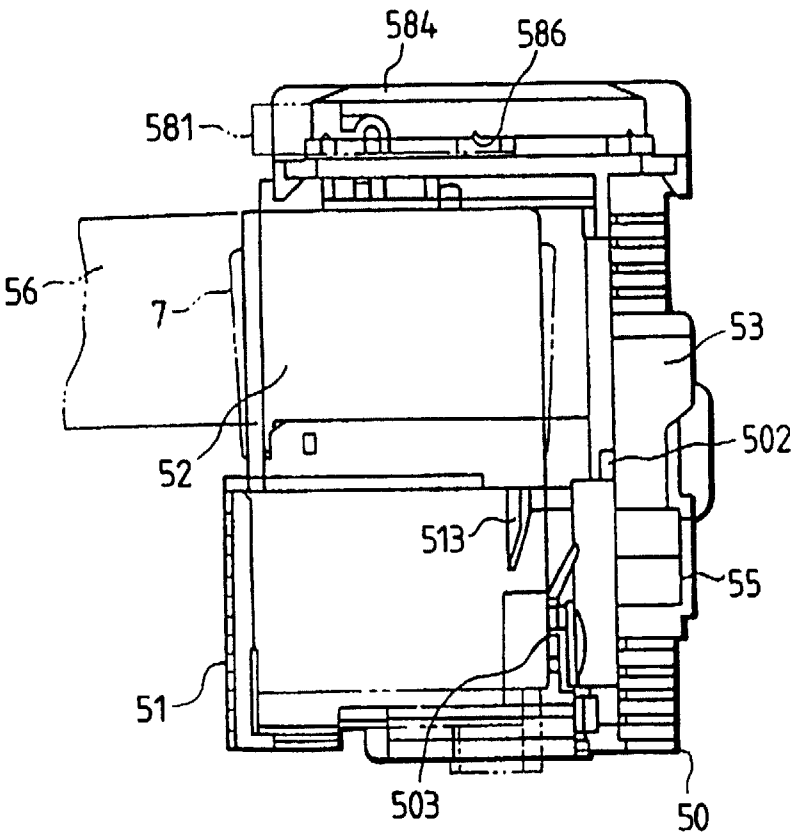
FIG. 5A is a front view which shows a hook lever 53 and others in the carriage unit 5 illustrated in FIG. 1.
Figure 6:
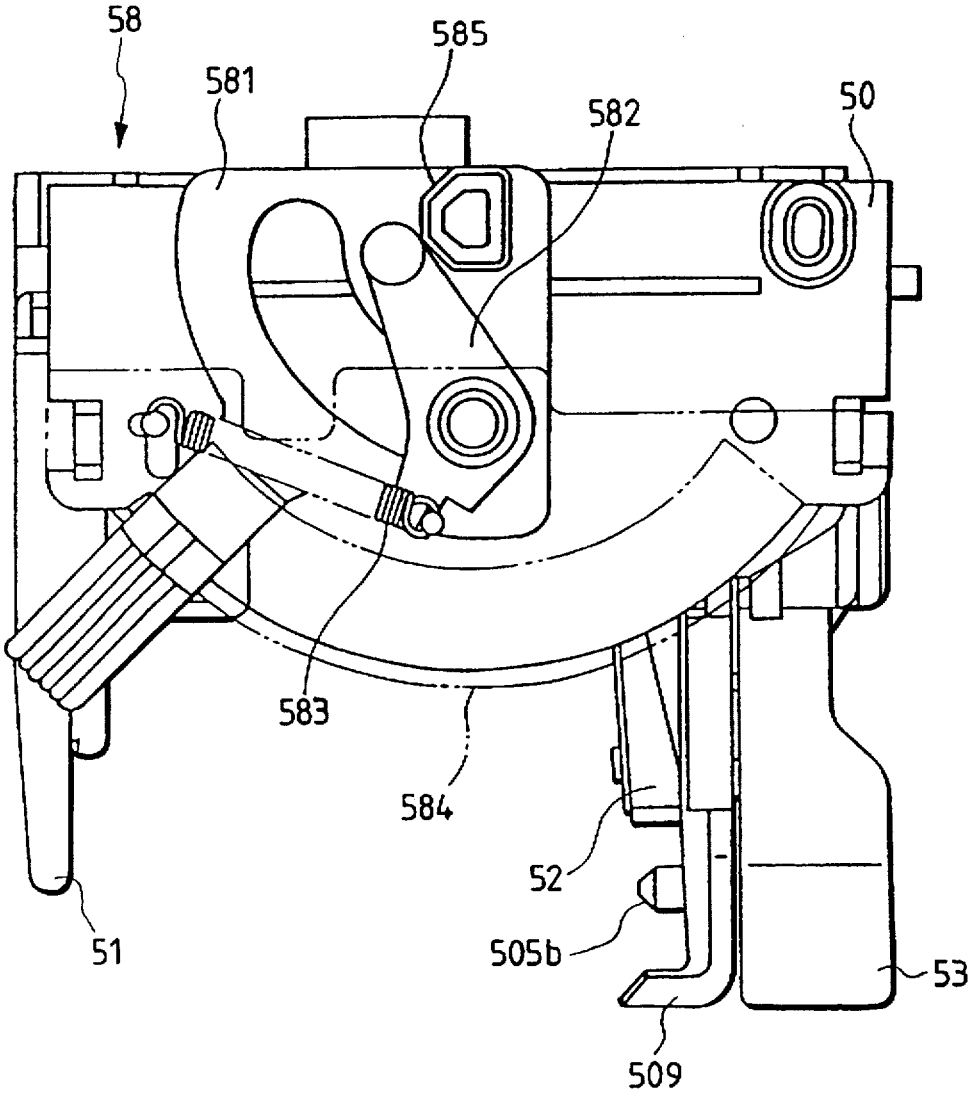
FIG. 6 is a plan view which shows the carriage unit 5 illustrated in FIGS. 5A and 5B.
Figure 8A:
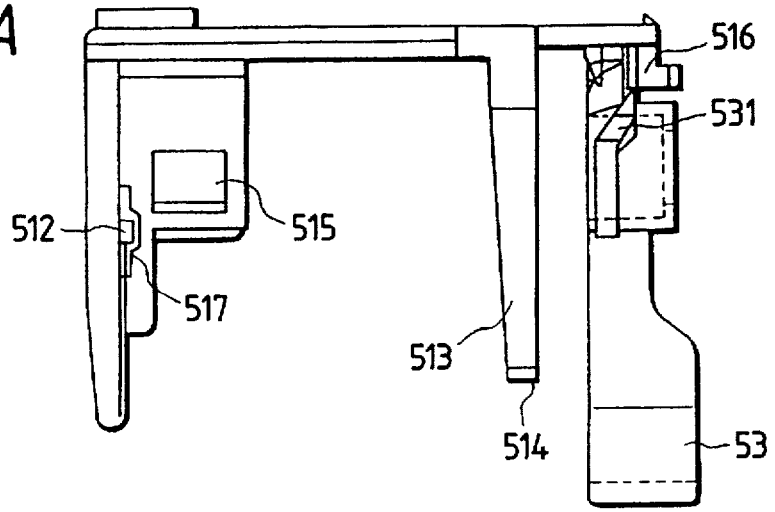
FIG. 8A is a plan view which shows the principal structure of the head attachment and detachment mechanism of the recording apparatus represented in FIG. 1.
Figure 8B:
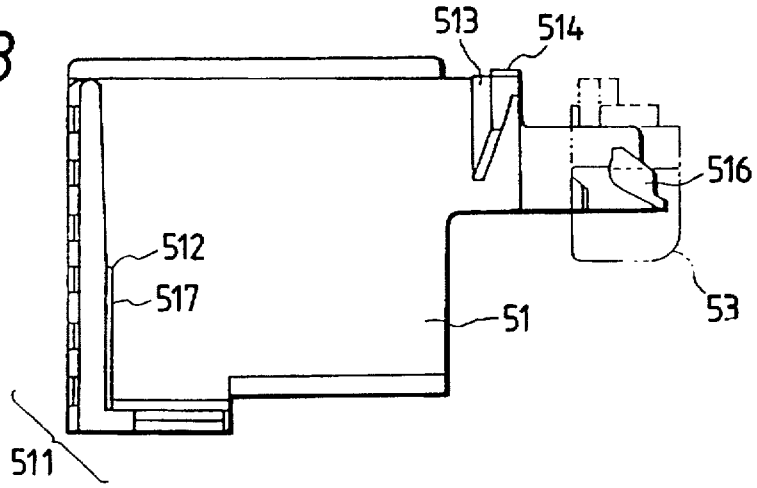
FIG. 8B is a front view thereof.
Figure 8C:
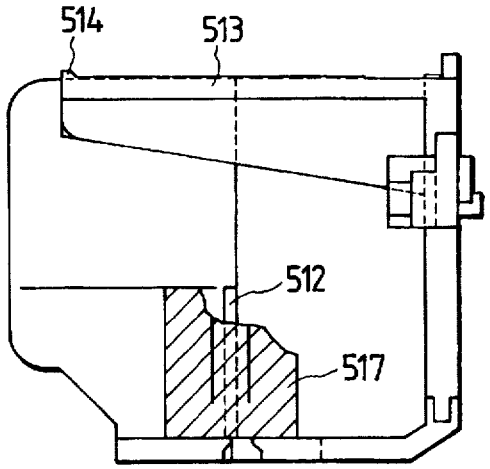
FIG. 8C is a side view thereof.
Figure 9A:
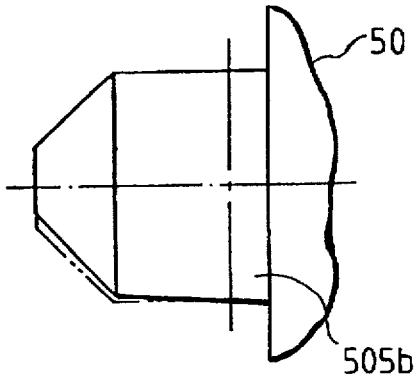
FIG. 9A is an enlarged side view which shows a fitting pin **505*b* illustrated in FIG. 7**.
Figure 9B:
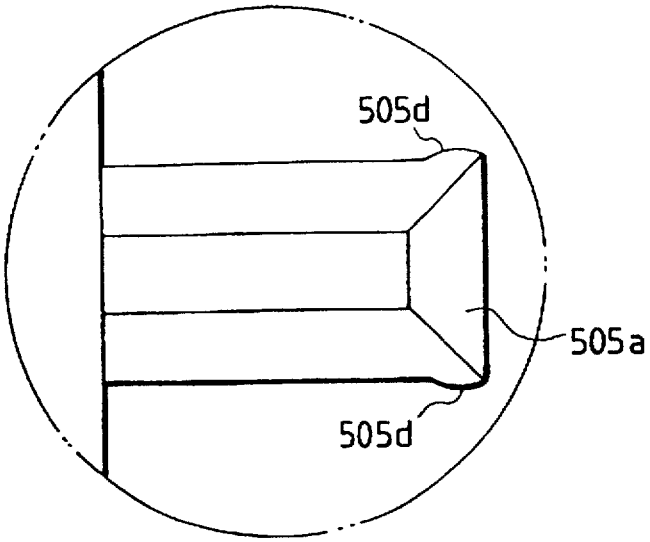
FIG. 9B is an enlarged view which shows a fitting pin **505*a* illustrated in FIG. 7**.
Figure 10A:
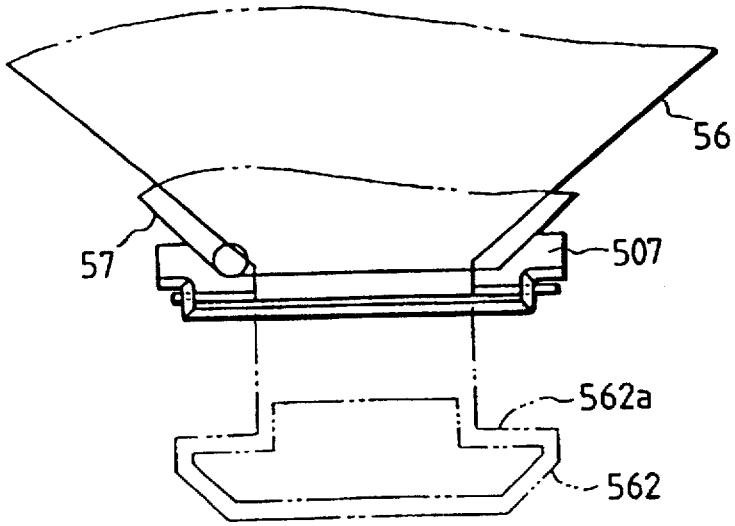
FIG. 10A is a view which shows a state of the leading end portion of the flexible board 56 represented in FIG. 1 before its incorporation is made.
Figure 10B:
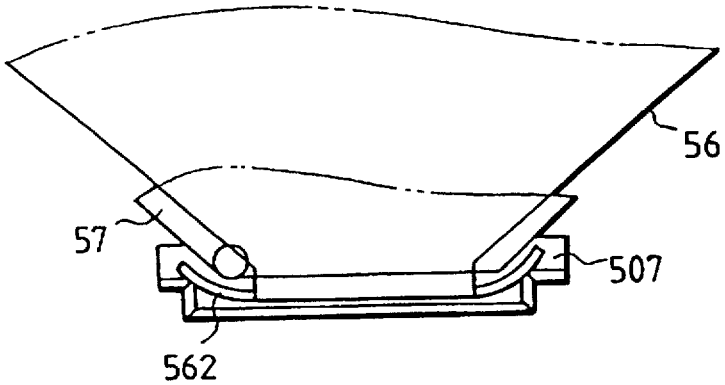
FIG. 10B is a view which shows a state thereof while the incorporation is being made.
Figure 10C:
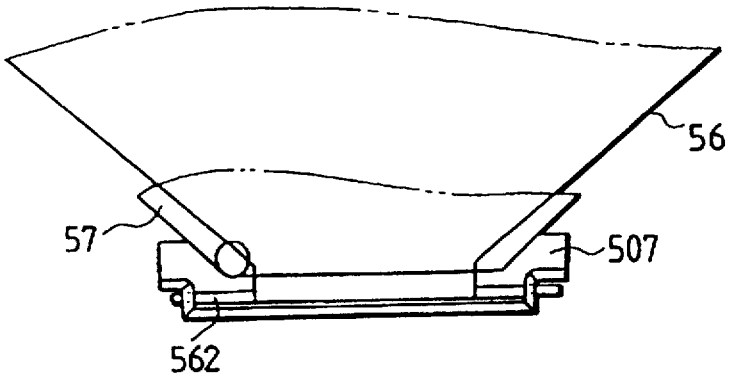
FIG. 10C is a view which shows a state thereof after the incorporation has been made.
Figure 11:
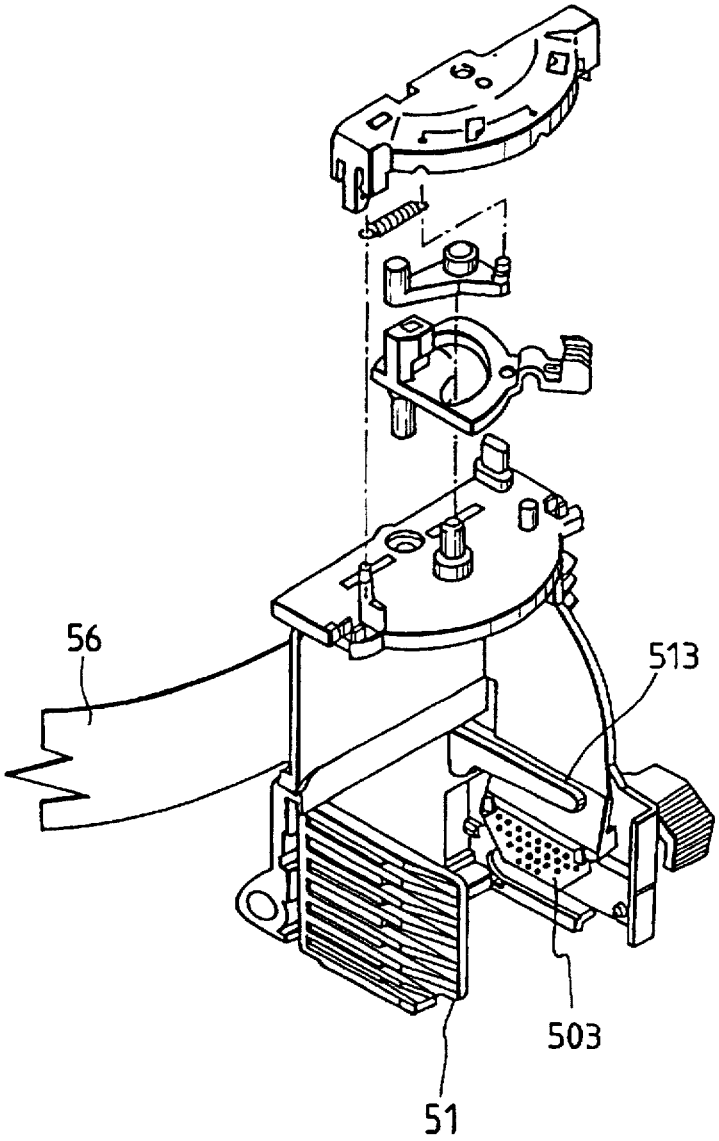
FIG. 11 is a partially exploded perspective view which shows the carriage 50 represented in FIG. 1.
Figure 12:
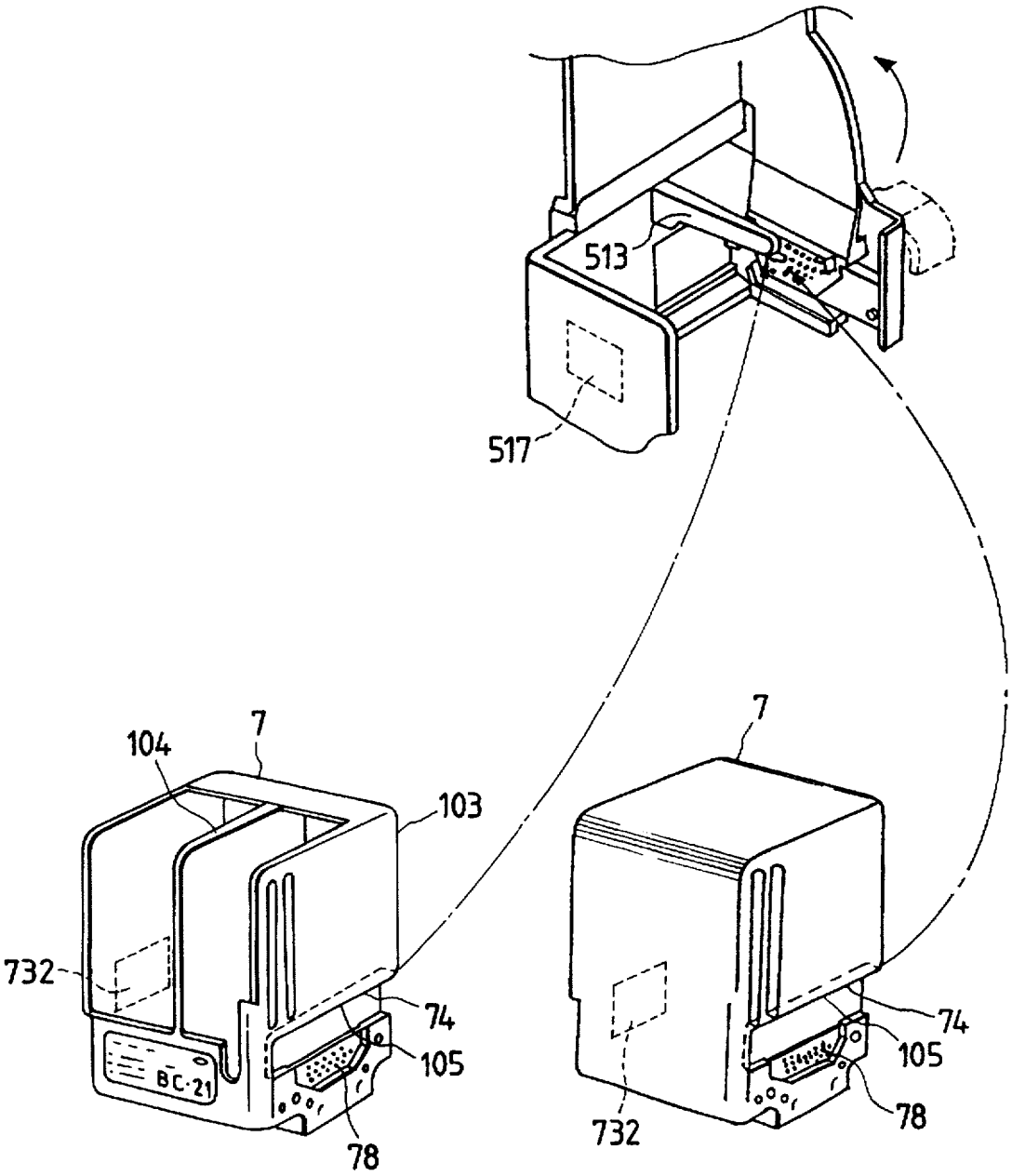
FIG. 12 is a perspective view which shows the coupling relations between the guide arm 513 illustrated in FIG. 11 and the recording head.
Figure 15B:
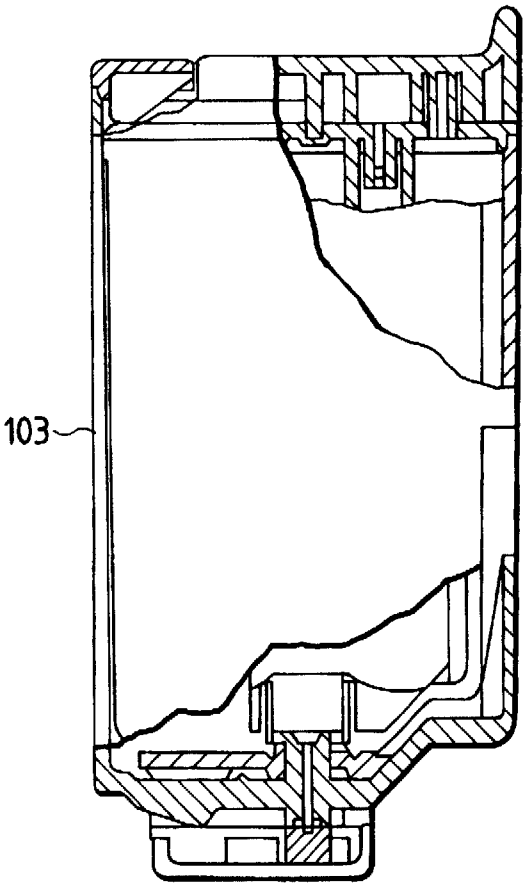
FIG. 15B is a partially cross-sectional side view of the recording head 7 shown in FIG. 14.
Figure 15A:
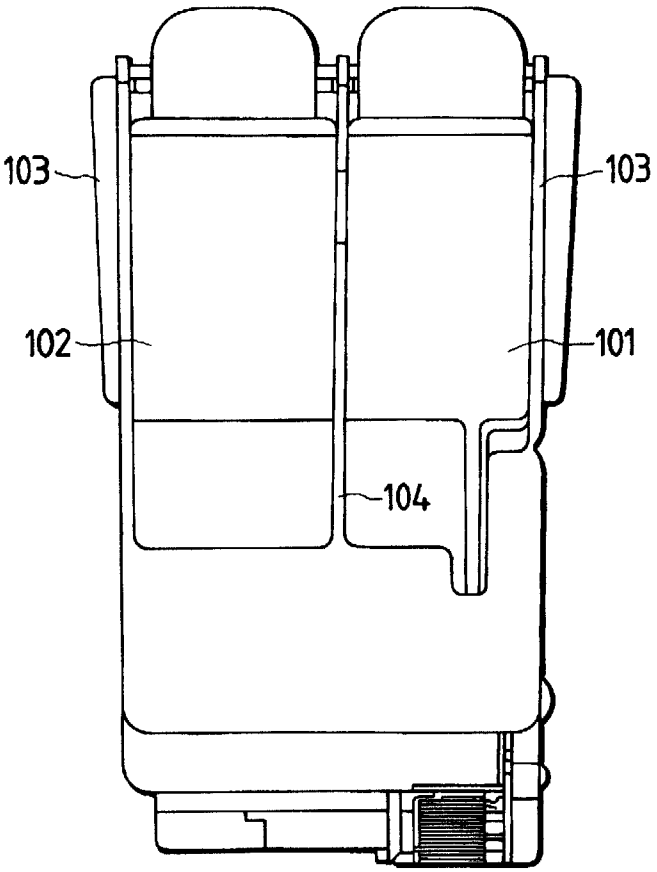
FIG. 15A is a front view of the recording head 7 shown in FIG. 14.

The carriage 5 forms a unit by fixing each of its parts to the carriage 50. FIGS. 4A to 4D are views which show the external appearance of the recording head 7. FIGS. 5A and 5B are front views of the carriage unit 5. FIG. 6 is a plan view of the carriage unit 5. FIG. 7 is a structural view showing the contact surface 503 and others of the carriage unit 5. FIGS. 8A to 8C are structural views which show the principal part of the attachment and detachment mechanism of the recording head 7. FIGS. 9A and 9B are views illustrating the structure of a head fixing pin 505 of the carriage 50. FIGS. 10A to 10C are views illustrating a state where the leading portion 562 of the flexible board 56 is incorporated. FIG. 11 is a perspective view of the carriage unit 5, and FIG. 12 is a view illustrating the engagement of the recording head with the carriage unit 5.

The attachment and detachment unit of the recording head 7 comprises the carriage 50, the head holder 51, a base cover 52, a rubber pad 53, a contact spring 54, a hook cover 55, the flexible board 56, and a rubber pad 57 (see FIGS. 5A, 5B and FIG. 7).

As shown in FIG. 5A to FIG. 8C, the head holder 51 is structured to slide to the left and right along the guide 501 arranged on the carriage 50 with the recording head mounted on it. For the head holder 51, there are arranged a guide unit 511 (see FIGS. 8A to 8C) to guide the recording head 7, and a pressure unit 512 (see FIG. 8B) having adhesively bonded thereon a sheet member 517 whose friction coefficient is low (polymer polyethylene, ethylene tetrafluoride resin, or the like) in order to press the recording head 7 to the contact surface 503 and positioning surface 504 of the side board 502 vertically planted on the carriage 50. Thus the recording head 7 is in contact when the pressure unit 512 is caused to press the pressure receiving portion 732 of the recording head 7 (see FIG. 4C). In this case, even if the recording head 7 is inserted with an inclination, it is easier to position the recording head exactly because of the small friction coefficient given to the sheet material 517 adhesively bonded on the pressure unit 512. The positioning surface of the side board 502 (see FIG. 5A) of the carriage 50 is arranged at three points (at 504*a*, 504*b*, and 504*c*). There are arranged two points (at 72*a* and 72*c*) on the base plate 72 (see FIGS. 4A to 4D) in the vicinity of the nozzles 70 of the recording head 7, and a point (at 72*c*) above the ink tank 73 of the recording head 7. The contact surface 503 (see FIG. 5A) between the recording head 7 and the carriage 50 is arranged to be positioned within a triangle formed by these three points of the positioning surface 504 (see FIG. 7). The pressing position of the pressure unit 512 of the head holder 51 is located within this triangle. Also, in the position opposite to the pressure unit 512 of the head holder 51, the guide arm 513 is provided (see FIG. 4A and FIG. 11), and this guide arm 513 (FIG. 8A) acts upon the recording head 7 when the recording head 7 is caused to retract from the contact surface 503. The guide 74 is formed on the recording head 7. As shown in FIG. 11, it engages with the guide arm 513. Here, the surface 105 of the guide 74 is formed in a configuration that agrees with the upper surface of the guide arm 513.

Further, the guide arm 513 is tapered in the direction toward the front thereof. As the configuration of the guide 74 of the recording head 7 agrees with this tapered configuration, it is possible to conduct the mounting and removal of the recording head smoothly, and at the same time, to complete the provisional positioning of the recording head 7 by fitting the guide 74 deep into the end of the guide arm 513. After that, the head holder is allowed to shift by the operation of the hook lever 53 to effectuate the exact positioning.

Also, on the side board 502 of the carriage 50, a rib 509 (see FIG. 7) is arranged to protect and hide the contact surface 561 (FIG. 7) and others of the flexible board 56 which will be described later. This rib functions dually as a guide when mounting or removing the recording head 7.

As shown in FIGS. 4A to 4D, a guide 74 is arranged on the side face of the ink tank 73 of the recording head 7, which is mounted along the upper surface of the guide arm 513. Then, on the given position where the recording head 7 is mounted, there are provided a recess 75 (see FIG. 4D) on the guide 74 for the recording head 7, and an extrusion 514 (see FIGS. 8A to 8C) is arranged as regulating means in the position facing the head holder 51. Further, on the bottom face of the recording head 7, an extrusion 76 (see FIG. 4B) is arranged, while on the corresponding portion on the head holder 51 to receive the head, a recess 515 (FIGS. 8A to 8C) is arranged corresponding to the extrusion 76. In this way, it is possible to avoid any possible damage given to the recording head, because the recording head is mountable without causing the surface 70 of its nozzles to abut upon the platen 34 and others. Also, a clicking sense is obtainable when mounting the recording head, hence improving its mounting effect. Also, the catching of the recess 514 (FIGS. 8A to 8C) of the head holder 51 makes it possible to prevent the recording head 7 from dropping forwardly when mounting or removing the recording head 7, and eliminate instability such as its displacement or the like after mounting. Moreover, the portion 732 to be pressed is given a mirror finish surface treatment on it to prepare its surface flat and smooth in order to reduce slide resistance between this portion and the pressure unit 512. In this case, the mirror finish surface treatment is given only to this particular portion 732 to be pressed. The exterior of all the other parts is texture coated so that this function is sufficiently satisfied without spoiling the outer appearance.

The hook lever 53 (FIGS. 8A to 8C) is rotatively mounted on the side board 502 of the carriage 50. On the axial center of the hook lever 53, the contact spring 54 (FIG. 5B) is provided to bias the hook lever 53 in the direction indicated by an arrow. The hook cover 55 (FIG. 5A) is fixed to cover the hook lever 53 to hold the hook lever 53 so that it does not come off from the carriage 50. As shown in FIGS. 8A to 8C, the hook lever 53 and the head holder 51 are respectively provided with the cams 516 and 531 to abut upon each other, and it is structured to cause the head holder 51 to shift in the directions to the left and right by the rotation of the hook lever 53. Also, the biasing force of the contact spring 54 is transformed into the force exerted by the head holder 51 to press the recording head through the hook lever 53.

On the side board 502 of the carriage 50, a fitting pin 505 is arranged to position the recording head 7. As shown in FIGS. 7, 9A and 9B, this fitting pin 505 is arranged at two locations (at 505*a* and 505*b*) so that two of them are fitted into the fitting holes 77*a* and 77*b* arranged correspondingly on the base plate 72 of the recording head 7, respectively. The base plate 72 of the recording head 7 is structured so that it is inclined at an angle of approximately one to four degrees from the drive of the recording head 7 to the scanning direction of the carriage unit 51. In order to match with the inclined fitting holes 77*a* and 77*b*, one of the fitting holes 77 on the base plate 72 of the recording head 7 is made a square hole 77*a*, and then, the fitting pin 505*a* on the carriage 50 side, which corresponds thereto, is made a partially column shaped square pin 505*d*. Further, the fitting pin 505*b* on the carriage side, which corresponds to the circular hole 77*b*, is arranged so that it can fit to the positioning surface 504 of the carriage on the abutting position of the recording head 7 with the exception of the portion to be undercut due to the structural configuration of the carriage. In this way, it is possible to position the recording head 7 exactly and smoothly even on the inclined base plate 72 without the provision of any complicated structural configuration.

As shown in FIG. 7, the contact surface 503 (see FIG. 5A) arranged on the side board 502 of the carriage 50 is provided with a rubber pad 57 (see FIG. 7) made of silicon rubber or other elastic element having a rubber hardness of 30 to 50 degrees in consideration of the electrical contact with the recording head 7. Then, the contact unit 561 of the flexible board 56 is arranged on it. The rubber pad 57 and flexible board 56 are both positioned by means of the positioning pin 506 provided for the side board 502 of the carriage 50. On the opposite side of the positioning contact unit 561 of the flexible board 56, a slit 563 is arranged to form a structure so that any deformation that may take place in assembling the flexible board 56 does not affect the contact unit 561. The leading end 562 (see FIGS. 10A to 10C) of the contact unit 561 of the flexible board 56 is thinned in order to match the configuration of the base plate 72 of the recording head 7, and a catching portion 562 is arranged on its end. Thus the contact unit 561 is made a triangle in its shape, and the number of the contact pads is reduced more as it is closer to the leading end to make it easier to design wiring and attain a higher density thereof. Moreover, it becomes easier to process the leading end portion 562 of the flexible board 56. On the side board 502 of the carriage 50, a slit hole 507 (see FIG. 7) is arranged to receive the leading end portion 562 of the flexible board 56. As shown in FIGS. 10A to 10C, this leading end portion 562 is bent when it is inserted into the slit hole 507. After passing the slit hole 507, the leading end portion is made straight so that it is firmly caught. As a result, it does not come off. In accordance with this structure, the leading end portion is free, while the contact unit 561 of the flexible board 56 is not rigid. Therefore, it is allowed to be in contact with the contact surface 78 (see FIG. 4D) of the recording head 7 in a good condition. When the recording head 7 is mounted, the contact surface 503 (FIG. 5A) of the carriage 50 enters the cut-off portion 79 of the base plate 72 of the recording head 7, and abuts upon the contact surface 78 on the board formed inside the cut-off portion 79 (see FIG. 7).

The flexible board 56 is drawn around along the side board 502 of the carriage 50 and fixed to the carriage 50 by the base cover 52 after being folded perpendicularly. Here, with the extrusion 564 (see FIG. 5B) for provisionally fixing the flexible board 56, it is possible to efficiently execute assembling when the base cover 52 is mounted because the flexible board 56 can be fixed by holding the extrusion 564 in place on the carriage 50. Further, a pressure unit 521 is provided for the base cover 52 to prevent the respective coupling sections of the aforesaid rubber pad 57 and positioning holes for the flexible board 56 from coming off the pin 506 on the carriage 50. Also, recesses 731 (see FIG. 4D) are arranged for the recording head 7 in order to escape the positioning pin 506 and the extruded portion of the pressing unit 521 of the base cover 52. Therefore, it is possible to gain the length of the positioning pin 506 and the thickness of the pressing unit 502 of the base cover 52 sufficiently, hence reliably preventing the coming off of the rubber pad 57 and means for positioning the flexible board 56. The flexible board 56 is fixed to the chassis 8 by means of the flexible fixing board 85 (see FIG. 2), and its curvature is being changed in accordance with the positions of the carriage unit 5. Thus, in response to the movement of the carriage unit 5, the head driving signals are being transmitted from the electrical board 9 to the recording head.

With the structure described above, it is possible to easily perform the attaching and detaching of the recording head 7 to and from the carriage unit 5, its holding, positioning, and electrical connection, among some others. FIGS. 5A and 5B are front views which show the carriage unit 5 at the time of the recording head being attached or detached thereto and therefrom. When the recording head 7 is mounted, the hook lever 53 is lift upward as shown in FIG. 5A to move the head holder 51 to the left-hand side so that the recording head 7 can be mounted. In this state, the recording head is mounted, and then, the hook lever 53 is rotated downward to cause the head holder 51 to shift to the right-hand side together with the recording head; hence the recording head 7 being positioned, while the electrical connection and others being executed. In this state, it is possible to form images on the sheet materials P. Further, when the recording head 7 is removed from the carriage unit 5, the hook lever 53 is lift upward as shown in FIG. 5B to cause the head holder 51 to shift to the left-hand side. Then, the guide arm 513 (see FIGS. 8A to 8C) of the head holder 51 presses the recording head 7 to the left side. As a result, the recording head 7 can be removed from the carriage unit 5.

On the upper part of the carriage 50, there is arranged a sheet gap adjusting unit 58 (see FIG. 1) for making adjustment the gap between the recording head 7 and recording sheets P. The sheet gap adjustment unit 58 comprises an adjustment lever 581, a pressure lever 582, and a pressure spring 583, and a top cover 584 (see FIG. 6).

The adjustment lever 581 is rotatively formed by inserting a pin (not shown) into a hole (not shown) arranged for the carriage 50. The adjustment lever 581 is provided with polygonal sliding surfaces 585 having different distances from the rotational center of the adjustment lever in accordance with the number of positions of gap between the head and sheet. The pressure lever 582 is rotative around the pin arranged for the carriage 50, and biased to the guide rail 82 by means of the pressure spring 583. By changing the slid surfaces 585 of the adjustment lever 581, the carriage 50 rotates around the guide shaft 81 so as to cause the gap to be changed between the sheet and head. The top cover 584 is fixed to the carriage 50 by means of nails on both sides to hold the adjustment lever 581, the pressure lever 582, and others. Further, the leading end of the adjustment lever 581 is made elastic to fix the adjustment lever 581 in cooperation with the groove 586 of the top cover 584 for the provision of a given gap between the sheet and head.

The carriage unit 5 can reciprocate to scan with the arrangement that the bearing of the carriage 50 is fitted over the guide shaft 81 mounted on the chassis 8, and that the adjustment lever 581 and the pressure lever 582 slide on the guide rail 82 mounted on the chassis 8 likewise. On the back side of the carriage 50, the timing belt 83 is fixed. The timing belt 83 is tensioned around the pulley 801 mounted on the shaft of the carriage motor 80 mounted on the chassis 8, and the idle pulley 84 also mounted on the chassis 8 for the purpose of tensioning the timing belt 83.

For this recording apparatus, the recording head 7 is detachably mounted on the carriage 50 as indicated by an arrow in FIG. 14. The holder 103 is fixed to the recording head 7 to provide a mode of a head-ink tank holder. The holder 103 is formed by a flexible material. An intermediate partition 104 is arranged, and then, between the holder 103 and the intermediate partition 104, a black ink cartridge 101 and a color ink cartridge 102 are stored. As shown in the enlarged views $17_1$ and $17_2$ of FIG. 13, the recording head 7 can be mounted and removed on and from the carriage 50.

It is desirable to make the holder 103 and the intermediate partition 104 thin from the viewpoint of providing more space for a larger black ink cartridge 101 and color ink cartridge 102 to be received in the head-ink tank holder. In this respect, this thickness is designed to be in a range where the rigidity of the recording head 7 as a whole is good enough to hold the electrical connection between its electric contact surface 78 and the corresponding electrical contact surface 503 of the carriage 50.

For the recording head 7, the guide 74 is prepared at the same time that the recording head 7 is formed, and as shown in FIG. 12, it is made movable by coupling this guide and the guide arm 513 of the carriage 50. The recording head 7 is arranged to continue image formation by exchanging only ink cartridges when ink has been consumed. It is unnecessary to replace recording heads 7, thus contemplating the curtailment of running costs.

Figure 16A:
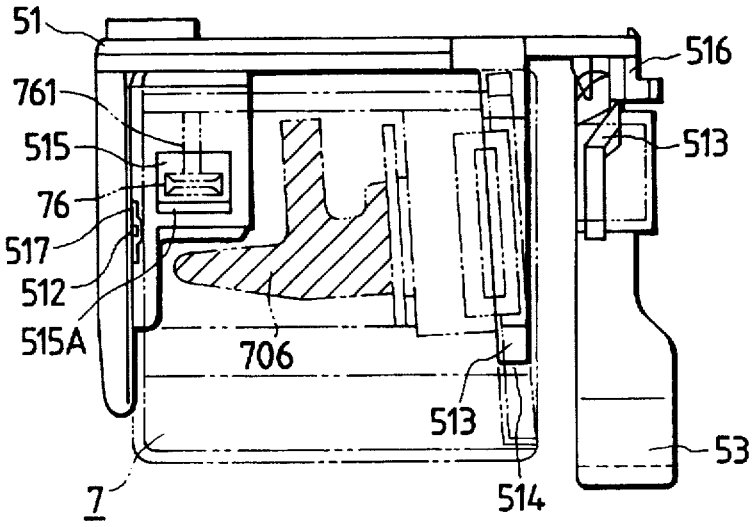
FIG. 16A is a view which shows the upper surface of the principal structure of a head attachment and detachment mechanism in accordance with the present embodiment.
Figure 16B:
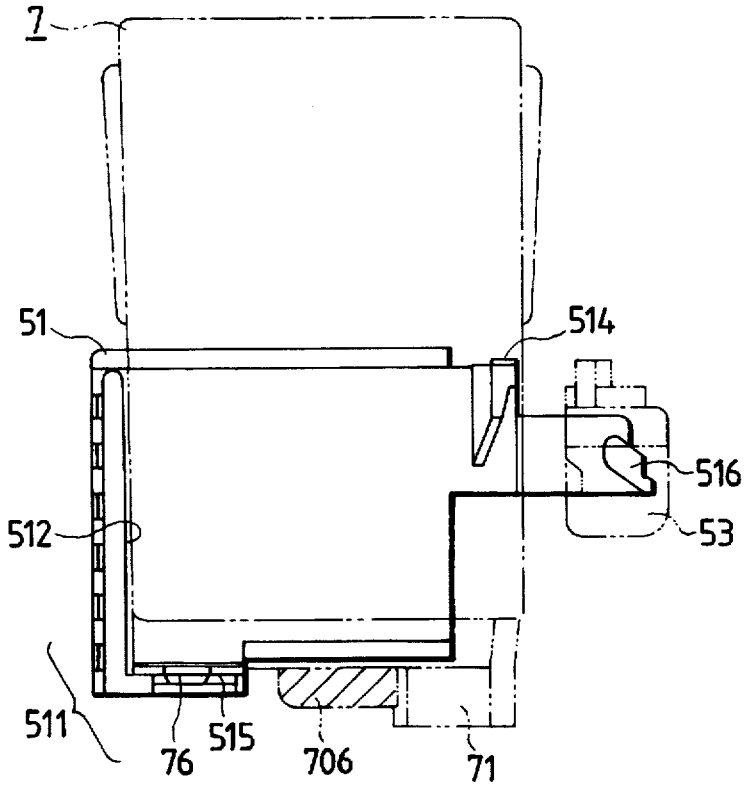
FIG. 16B is a front view thereof.

On the bottom face of the recording head 7, there are provided the rib 76 for making provisional positioning, the tube 706 for transferring ink from an ink tank to the head unit 71, and some other extrusions than the head unit 71. However, as shown in FIGS. 16A and 16B, the head holder 51 is cut off so that it can hold the bottom face of the recording head 7 while escaping this tubing 706. In this way, it is possible to place the nozzle surface 70 close to the sheet materials P, hence obtaining output in a higher quality. Also, when the color head 7 is used as shown in FIGS. 17A to 17E, there is need for arranging tubes per color. Therefore, taking into account that the area occupied by the tubing 706

(indicated by slanted lines in FIGS. 16A and 16B) becomes wider, the configuration of the aforesaid cut-off portion is decided to make it possible to use this head unit both for color and monochromic image formation.

FIGS. 17A to 17E schematically illustrate the structure of the recording head unit 71 provided with the ink tank mounting units 710 and 711 mounted on the carriage of an ink jet recording apparatus.

There are provided in this respect a housing 703 having a pair of side boards of the head unit 71 and back board to couple this pair of side board; a front board 713 to form a space for storing ink tank in the housing 703 arranged with respect to the back board of the housing 703; and an intermediate board 704 to divide the space surround by these boards into two areas. The areas thus divided are to be a mounting unit 710 for color ink tank, and also, a mounting unit 711 for black ink tank. Here, the height of the front board 713 is made approximately ⅓ of that of the housing 703 in order to execute the attachment and detachment of the ink tanks from the aperture arranged on the front board 713 side.

On the upper end of the back board that forms the housing 703, a cover 705 is arranged to extrude to the mounting units 710 and 711 side. For the cover 705, an inclined portion 705*a* is provided from the inserting side toward the mounting units 710 and 711 in order to create a resisting sense of an ink tank being inserted. This cover 705 is arranged in a position that interferes with the corner on the side opposite to the ink supply port on the depth side of the ink tank insertion. The resisting sense at the time of insertion is increased by the inclination given to the aforesaid position at 705*a*. At the point where the aforesaid corner reaches the flat biasing means 705*b* that is arranged in continuation with the inclined portion 705*a*, this resisting sense is eliminated, and the clicking effect is created. This biasing means 705*b* exerts a pressing force vertically from the top to bottom on the ink tank mounted in the mounting unit.

On the bottom face of the recording head unit 71, outlet tubes 707 (Y, M, C, Bk (M and Bk are not shown)) are arranged to be inserted into the ink tanks in order to supply ink from them to the recording head unit 201, respectively. A given length of each tube is extruded into the interior of the mounting units 710 and 711 to effectuate such insertion into each ink tank.

On the aperture of outlet tubes 707 arranged on the mounting unit 710 side where the color ink tank and black ink tank are mounted, filters 709 (Y, M, C, and Bk (Bk is not shown)) are provided as shown in FIGS. 17A to 17E. Each filter is extruded into the respective mounting units 710 and 711 in a given length in order to effectuate such insertion into the ink supply port of each ink tank, respectively.

Figure 17A:
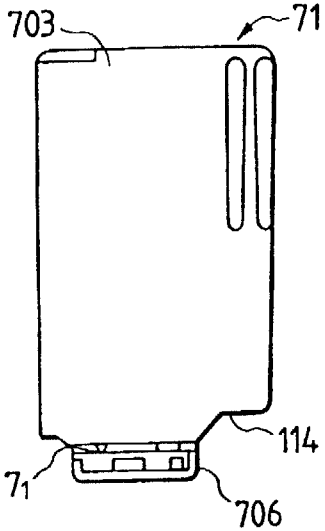
FIG. 17A is a side view which schematically shows the structure of a recording head unit with an ink tank being mounted thereon in accordance with the present embodiment.
Figure 17B:
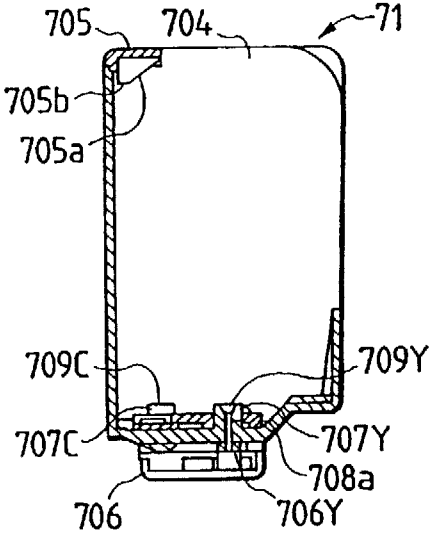
FIG. 17B is a cross-sectional view thereof.
Figure 17C:
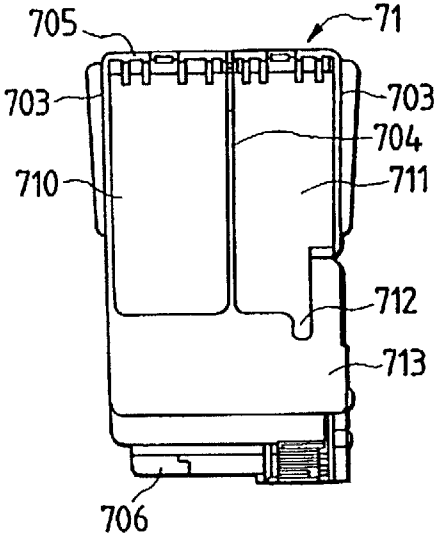
FIG. 17C is a front view thereof.
Figure 17D:
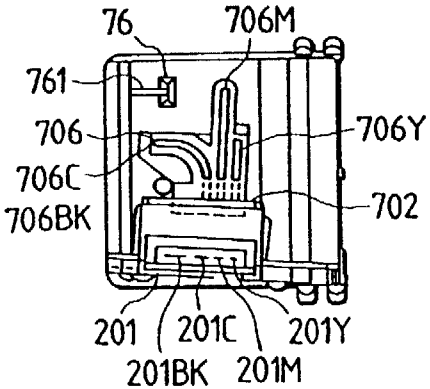
FIG. 17D is a bottom view thereof.
Figure 17E:
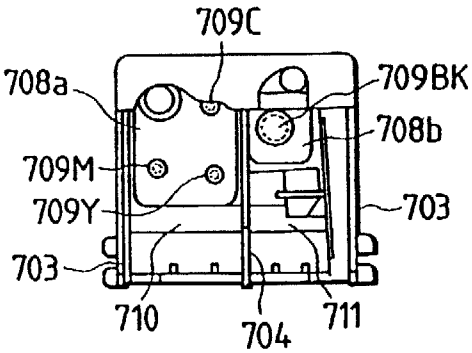
FIG. 17E is a view which shows the upper surface of the interior thereof.
Figure 18A:
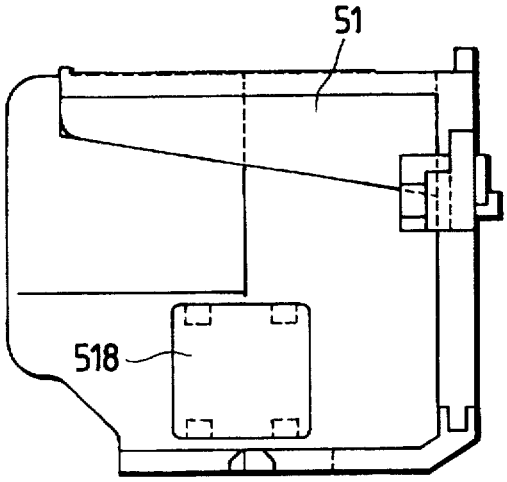
FIG. 18A is a view which shows the structure of a head holder in accordance with a second embodiment for a recording head of the present invention.
Figure 18B:
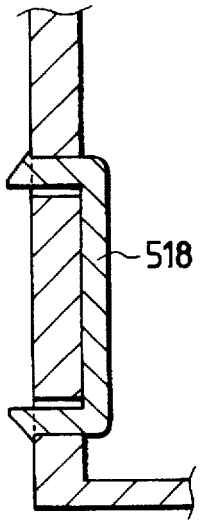
FIG. 18B is a partially enlarged cross-sectional view thereof.
Figure 19A:
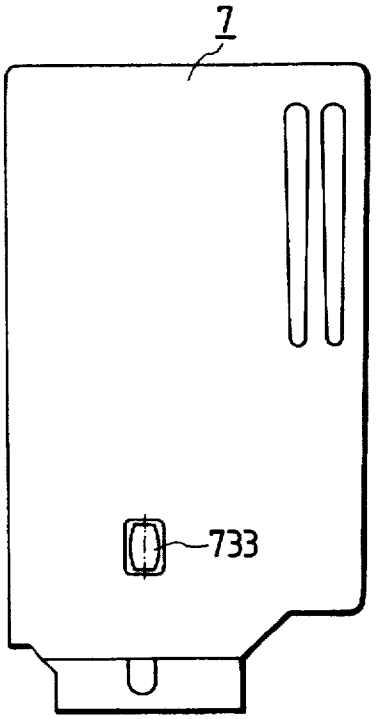
FIG. 19A is a side view which shows the recording head used for the recording apparatus represented in FIG. 18A.
Figure 19B:
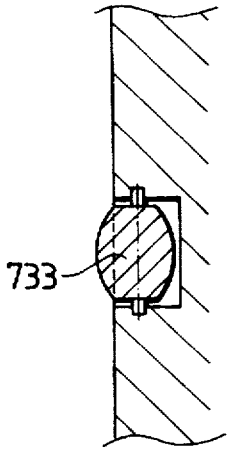
FIG. 19B is a partially enlarged cross-sectional view thereof.

From the output tubes 707 to the recording head 7, ink supply tubes 706 (Y, M, C, and Bk) are arranged on the bottom face of the recording head as shown in FIG. 17D.

Also, on the surface of the mounting unit where the outlet tubes 707 are arranged, elastic plates 708*a* and 708*b* having a given thickness are laid on the circumference of the outlet tubes 707. The elastic plates 708*a* and 708*b* are provided so that ink does not leak into the ink cartridge when the rib provided for the ink supply port of ink tank is in contact with the tubes under pressure as described later.

In this respect, as shown in FIG. 17C, a cut-off portion 712 is prepared in a position on the front board 713, which faces the mounting unit 711. This provision of the cut-off portion enables the insertion of the rib arranged for the black ink cartridge for retaining black ink so that any erroneous insertion that may take place should be avoided with respect to the black and color ink tanks.

In the mounting unit 711 of the recording head cartridge 701 thus structured, the ink tank retaining black ink is mounted, while in the mounting unit 710 thereof, the color tank retaining yellow, cyan, and magenta is mounted.

With the structure described above in detail, the head unit 71 shown in FIGS. 17A to 17E makes the attachment and detachment of the ink tanks 73 easy. Further, on both corners on the bottom face thereof, a recess 114 is arranged (see FIG. 17A) in order to get around the sheet exhaust roller 41. Here, FIG. 12 shows the head holder 51 of the carriage 50, and each part of the head unit 71 such as the guide arm 513. FIG. 13 shows a state where either of the recording heads 7 or 71 (color) is able to be attached or detached.

Now, the description will be made of the operation of positioning the recording head 7 to the carriage 50.

Pressing force $F_1$ of the head holder 51 to press the recording head is exerted by means of the contact spring 54. It is set at approximately 2 kg to 3 kg. Also, force $F_2$ to deform the rubber pad 57 and others is set at approximately 1 kg to 2 kg in order to effectuate the electrical connection for transmitting the recording signals and driving energy to the recording head. Here, 0.5 kg to 1.0 kg that is equivalent to a force obtainable by $F_2-F_1$ becomes the pressing force that is given to press the recording head 7 to the three positioning portions 504*a*, 504*b*, and 504*c* (see FIG. 7) of the carriage 50.

Figure 24B:
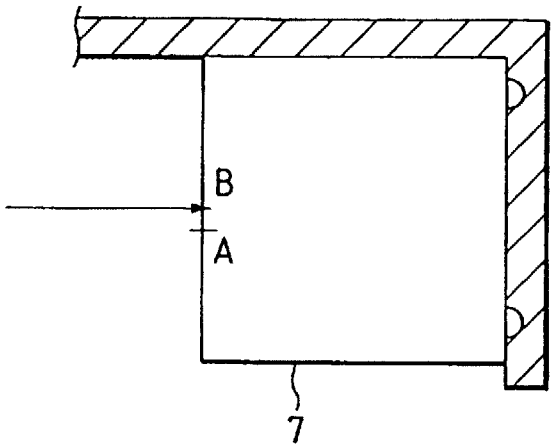
FIG. 24B PRIOR ART
FIG. 24B is a view which shows a state that the recording head represented in FIG. 24A has been positioned.
Figure 24A:
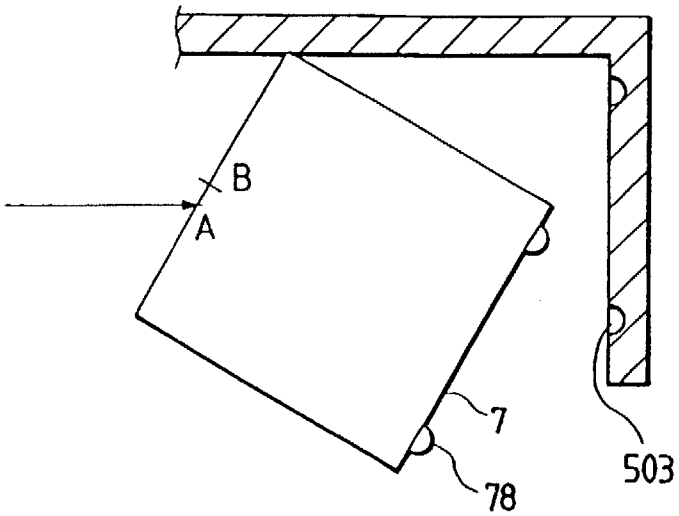
FIG. 24A PRIOR ART
FIG. 24A is a view which shows a state that the recording head represented in FIG. 23A is inserted into the recording apparatus with an inclination with respect to the direction in which it is pressed.

When the recording head 7 is mounted, it is assumed that the recording head 7 is inserted into the carriage 50 at an inclination in the direction of pressure (indicated by an arrow) shown in FIG. 24A. In this case, the position to receive the pressing force the pressure means is at A inevitably, which is different from the regular position B to receive the pressure.

At this juncture, the positioning sections 72*b* and 72*c* (see FIG. 4D), of the recording head 7 contact the positioning portions 504*b* and 504*c* of the carriage 50 first, respectively. Thus the recording head 7 is caused to rotate around the line connecting these two contacting points by the application of the pressing force equivalent to $F_2-F_1$. After that, the remaining positioning section 72*a* of the recording head 7 is caused to contact the positioning portion 504*a* of the carriage 50. At that time, the pressure unit 512 of the head holder 51 shifts slidably from the point A to point B as shown in FIG. 24B. The slide resistance force exerted then acts in the direction substantially rectangular to the acting direction of the pressing force of $F_2-F_1$of the recording head. As a result, if the slide resistance force is great at that time, the position of the pressure unit 512 of the head holder 51 to press the recording head 7 is not allowed to shift from the point A to the point B. Therefore, the mounting posture of the recording head 7 is not taken in a desirable condition with respect to the carriage 50, and the electrical connection between the electrical contact unit 561 of the carriage and the contact surface 78 of the recording head is not executed in a good condition, either.

In other words, it is desirable to make the strength of this slide resistance force as small as possible, because it affects the positioning of the recording head 7 to the carriage 50.

For the recording apparatus in accordance with the present embodiment, a sheet material of polymer polyethylene or the like having small friction coefficient is adhesively bonded to the pressure unit 512 of the head holder 51. Further, the portion at 732 of the recording head 7 to receive the pressure is given a mirror finish treatment of 3.2 S (JIS regulation: hereinafter, the same) or less or preferably, 0.8 S or less. With this arrangement, it is possible to reduce the slide resistance force to an extremely small value by making the mutual friction resistances smaller. In this way, the recording head 7 can be positioned exactly with respect to the carriage. Also, it is possible to obtain the same effect when the sheet material described above is adhesively bonded to the portion at 732 of the recording head to receive the pressing force.

Also, the guide arm 513 is tapered toward its leading end, and the guide 74 is formed for the recording head to couple it to the guide arm 513 for holding the head. Therefore, it is easy to attach and detach the recording head, and position it exactly.

Second Embodiment

In the first embodiment described above, the sheet material 517 having a low friction coefficient is adhesively bonded on the pressure unit 512 of the head holder 51. Then the portion at 732 of the recording head 7 to receive the pressing force is given a mirror finish treatment. However, in the present embodiment, a small member 518 having a low friction coefficient is used for the pressure unit of the head holder 51 as shown in FIGS. 18A to 19B, while a rotational roller member 733 is used for the portion of the recording head 7 to receive the pressing force. In this way, the slide resistance force is reduced between the pressure unit and the portion to receive pressure thus exerted.

As in the first embodiment, there is no fear in the present embodiment that the recording head is caught due to the resistance between the pressure unit and the recording head when it is mounted.

Third Embodiment

Figure 20A:
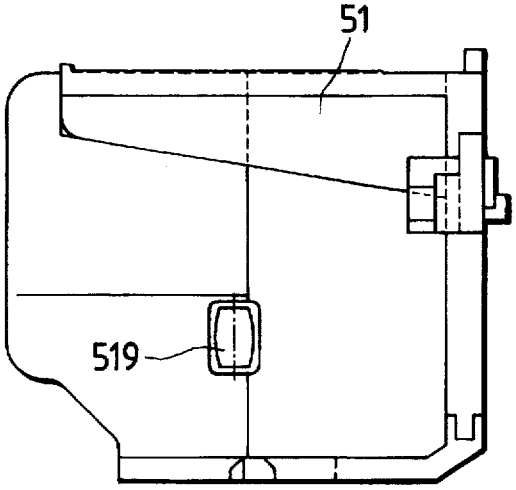
FIG. 20A is a view which shows the structure of a head holder in accordance with a third embodiment for a recording head of the present invention.
Figure 20B:
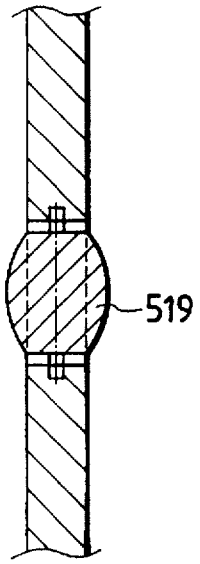
FIG. 20B is a partially enlarged cross-sectional view thereof.
Figure 21A:
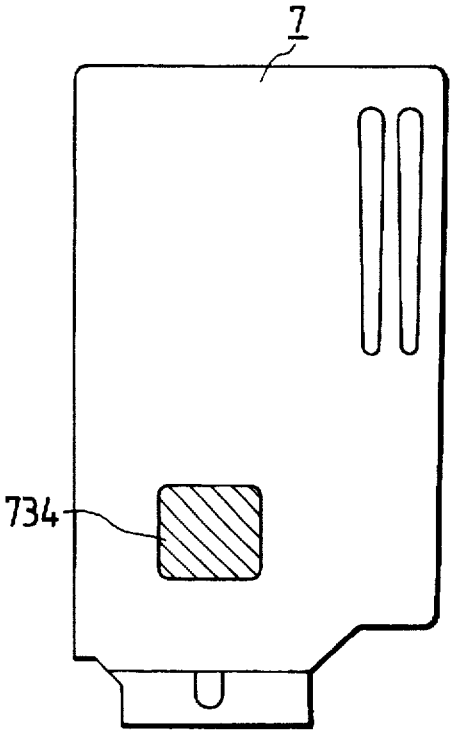
FIG. 21A is a side view which shows the recording head used for the recording apparatus represented in FIG. 20A.
Figure 21B:
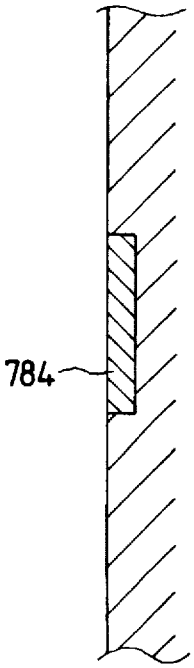
FIG. 21B is a partially enlarged cross-sectional view thereof.
Figure 22B:
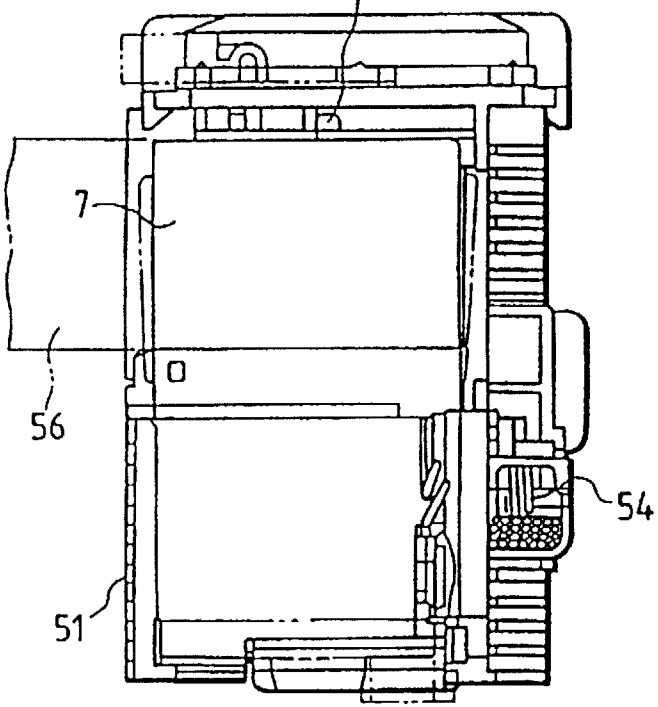
FIG. 22B PRIOR ART
FIG. 22B is a front view which shows the contact spring and others for the carriage represented in FIG. 22A.
Figure 22A:
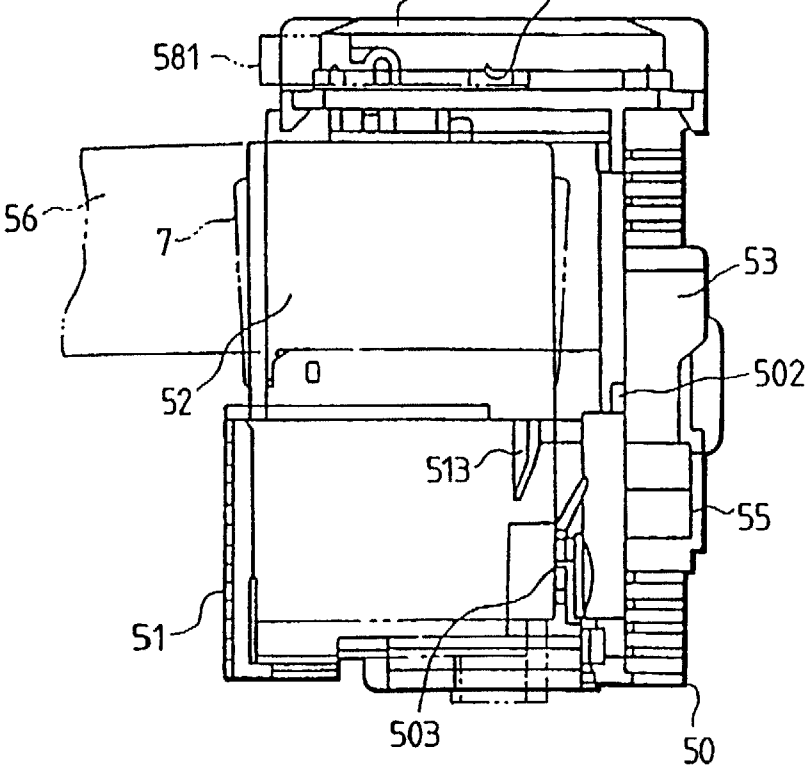
FIG. 22A PRIOR ART
FIG. 22A is a front view which shows the hook lever and others for a carriage of a recording apparatus related to the background art of the present invention.
Figure 23A:
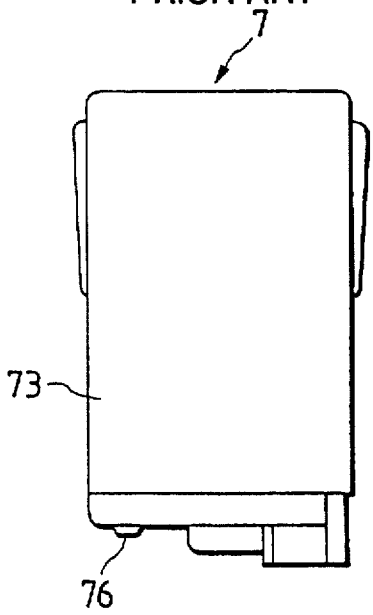
FIG. 23A PRIOR ART
FIG. 23A is a front view which shows a recording head used for the recording apparatus represented in FIG. 22A.
Figure 23B:
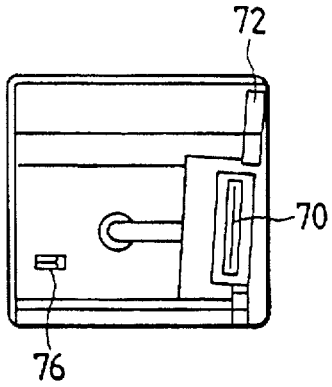
FIG. 23B PRIOR ART
FIG. 23B is a bottom view thereof.
Figure 23C:
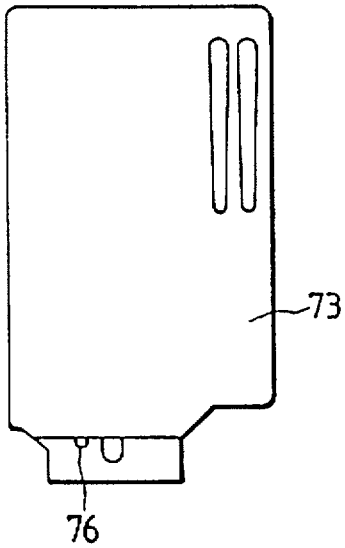
FIG. 23C PRIOR ART
FIG. 23C is a side view which shows the left-hand side thereof.
Figure 23D:
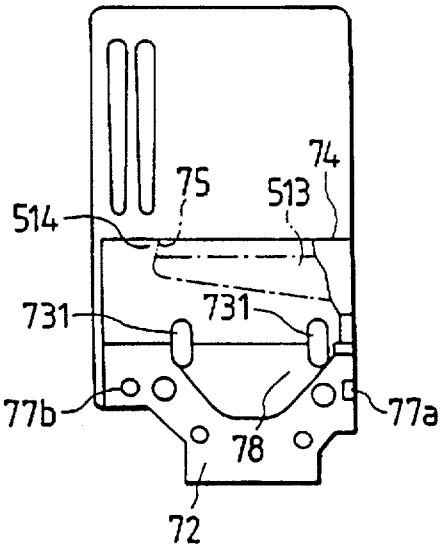
FIG. 23D PRIOR ART
FIG. 23D is a side view which shows the right-hand side thereof.

In the second embodiment, a small member having a low friction coefficient is fixed to the pressure unit of the head holder 51, while a roller member 733 is used for the portion of the recording head 7 to receive pressure. However, in the present embodiment, as shown in FIGS. 20A and 20B, a rotational roller member 519 is provided for the pressing means of the head holder. Also, as shown in FIGS. 21A and 21B, a sheet material 734 having a low friction coefficient is adhesively bonded to the portion of the recording head to receive pressure. In this way, the slide resistance is reduced between the pressure unit and the portion to receive pressure. Here, the sheet material is adhesively bonded in the recess of the recording head, but it may be possible to bond it on the flat surface. In such a case, it is possible to obtain the same effect if a small member having a low friction coefficient is mounted on the portion of the recording head to receive pressure instead of the sheet material.

In the present embodiment, too, there is no fear that the recording head is displaced from the given position because of the recording head being caught while it is mounted.

In this respect, the description has been made in each of the embodiments described above that separate members are provided to reduce the slide resistance, but it may be possible to form each of the constituents itself (or at least those contacting portions) with elements having a low friction coefficient.

As described above, each of the embodiments is effective to carry out the exact positioning of the recording head reliably by reducing the slide resistance between the pressing means of the recording apparatus and recording head, hence making it possible to prevent any malfunction from being caused in printing or performing a recording apparatus due to imperfect electrical contact or failure thereof.

Also, with the provision of a holder unit for the recording head, which makes it easy to attach and detach an ink cartridge to and from the holder, there is no need to replace recording heads themselves when ink has been consumed, thus obtaining an effect that the running costs are reduced significantly.

Further, the positioning guide member is tapered toward its leading end, while a stepping portion is arranged for the engagement of the recording head with the guiding member, hence effectively implementing the positioning of the recording head easily and exactly.

What is claimed is:

1. An information processing apparatus for executing information processing on a sheet material using a head member arranged for information processing area, including the following:

a head mounting member for mounting a head member thereon, said head mounting member having a position for attaching and detaching said head member to and from said head mounting member, and a mounting position to mount said head member on said head mounting member by positioning said head member with respect to said head mounting member;

a pressing member movably arranged on said head mounting member, said pressing member abutting upon said head member mounted on said head mounting member to cause said head member to shift from the attaching and detaching position to the mounting position by pressing said head member; and a contact area for said pressing member and said head member to abut upon each other, said contact area being arranged to reduce slide resistance to occur in the direction different from the direction in which said head member shifts from the attaching and detaching position to the mounting position.

2. An information processing apparatus according to claim 1, wherein said mounting position is the position where the electrically connecting portion provided for said head member on its side and the electrically connecting portion provided for said head mounting member on its side are electrically connected.

3. An information processing apparatus according to claim 1, wherein said contact area is provided with a member arranged for said pressing member or said head member to reduce slide resistance.

4. An information processing apparatus according to claim 3, wherein said member arranged for said pressing member or said head member to reduce slide resistance is a sheet material having a low friction coefficient for its surface.

5. An information processing apparatus according to claim 4, wherein said sheet material is a polyethylene sheet.

6. An information processing apparatus according to claim 4, wherein said sheet material is an ethylene tetrafluoride resin.

7. An information processing apparatus according to claim 3, wherein said member arranged for said pressing member or said head member is a rotary element rotative in the acting direction of slide resistance.

8. An information processing apparatus according to claim 1, wherein said head member is an ink jet recording head for discharging ink from the ink discharge ports.

9. An information processing apparatus according to claim 1, wherein said head member is an ink jet recording head provided with electrothermal transducing elements for discharging ink from the ink discharge ports by the application of thermal energy generated by said electrothermal transducing elements.

10. An information processing apparatus according to claim 8, wherein said head member is provided with an ink tank unit, and ink supply tubes on the bottom of said head member to supply ink from said ink tank to an ink jet recording head unit, and said head mounting unit holds said head member without contacting said ink supply tubes.

11. A recording apparatus having means for attaching and detaching a recording head to and from a given position in a recording head mounting unit for the formation of images on a recording medium, means for positioning the recording head on the given position in the recording head mounting unit, and means for making electrical contact to transmit and receive electric signals to and from the recording head by abutting it upon the electrically contacting surface of said recording head mounted on said given position, including the following:

pressing means for pressing said recording head in a given direction to the side opposite to said contacting means and said positioning means; and a member for reducing slide resistance between said pressing member positioned with respect to the pressing direction of said pressing member, and said recording head.

12. An information processing apparatus according to claim 11, wherein the pressing member of said pressing means is separately provided with a part having a small friction coefficient.

13. An information processing apparatus according to claim 11, wherein the pressing member of said pressing means is a sheet material having a small friction coefficient.

14. An information processing apparatus according to claim 11, wherein the pressing member of said pressing means is provided with a rotational roller member having a contacting portion with said recording head and a contacting portion with said pressing means.

15. An information processing apparatus according to claim 11, wherein said recording head is provided with a flexible holder to receive detachably an ink cartridge retaining ink.

16. An information processing apparatus according to claim 11, wherein positioning means for positioning said recording head in a given position is provided with a guide member for use of positioning being tapered toward the front end where said recording head is mounted, and said recording head is provided with a step to be coupled to said guiding member for use of positioning for holding the recording head.

17. A recording head for forming images on a recording medium, being detachably mounted on a recording apparatus by attaching and detaching means using pressure means of the recording apparatus, and being provided with means for positioning said recording head on a given mounting position in said recording apparatus, and with means for making electrical contact to transmit and receive electrical signals to and from said recording apparatus, including the following:

means for receiving pressure to be exerted by the pressure means of said recording apparatus on the side opposite to the surface effectuating said positioning and said electrical contact;

said means for receiving pressure being formed to reduce slide resistance to said recording apparatus in the plane direction substantially perpendicular to the direction of said pressure.

18. An information processing apparatus according to claim 17, wherein the pressure receiving portion of said means for receiving pressure is separately provided with a part having a small friction coefficient.

19. An information processing apparatus according to claim 17, wherein the pressure receiving portion of said means for receiving pressure is a heat material having a small friction coefficient.

20. An information processing apparatus according to claim 17, wherein the pressure receiving portion of said means for receiving pressure is provided with a rotational roller member having a contacting portion with said pressure means and a contacting portion with said recording head.

21. An information processing apparatus according to claim 17, wherein the pressure receiving portion is provided with a surface prepared with a smaller surface roughness.

22. An information processing apparatus according to claim 17, wherein said recording head is provided with a holder unit capable of detachably receiving an ink cartridge retaining ink.

23. An information processing apparatus according to claim 17, wherein said recording head is provided with a step to hold it, said step being coupled to a guide member tapered toward its leading end for use of positioning for said recording apparatus.

24. An information processing apparatus according to claim 17, wherein said recording head is held by a carriage configured to avoid the ink transfer tubing arranged on the bottom of said recording head.

25. An information processing apparatus according to claim 17, wherein said recording head is held by a carriage configured to avoid the ink transfer tubing arranged on the bottom of said recording head, and also, provided with a recess to avoid means for carrying a recording medium formed to face the bottom corner of said recording head.

26. An information processing apparatus according to claim 25, wherein said recording head is provided with a rib for provisional positioning arranged on the bottom of said recording head, having a tapered portion formed thereon reaching the vertex from said bottom of the recording head.

* * * * *

UNITED STATES PATENT AND TRADEMARK OFFICE

CERTIFICATE OF CORRECTION

PATENT NO. : 5,784,082

DATED : July 21, 1998

INVENTOR(S) : SHINMACHI ET AL.

It is certified that error appears in the above-indentified patent and that said Letters Patent is hereby corrected as shown below:

On the cover page,

[57] ABSTRACT:

Line 22, "effect" should read --effects--.

COLUMN 1:

Line 58, "holds" should read --holes--.

COLUMN 2:

Line 28, "damages" should read --damage--.

Line 40, "are" should read --is--.

COLUMN 11:

Line 47, "lift" should read --lifted--.

Line 52, "head;" should read --head,--.

Line 56, "lift" should read --lifted--.

Line 64, "ment" should read --ment of--.

Line 66, "and" should be deleted.

COLUMN 12:

Line 9, "slid" should read --sliding--.

UNITED STATES PATENT AND TRADEMARK OFFICE

CERTIFICATE OF CORRECTION

PATENT NO. : 5,784,082

DATED : July 21, 1998

INVENTOR(S) : SHINMACHI ET AL.

It is certified that error appears in the above-indentified patent and that said Letters Patent is hereby corrected as shown below:

Line 37, "$17_1$ and $17_2$" should read --Figs. 13B and 13C,--; and "of Fig. 13," should be deleted.

COLUMN 13:

Line 11, "board;" should read --boards;--.

Line 14, "surround" should read --surrounded--.

COLUMN 14:

Line 11, "71" should read --$7_1$--.

COLUMN 15:

Line 64, "performing" should read --operating--.

COLUMN 16:

Line 35, "the" should read --an--.

Line 36, "the" should read --an--.

COLUMN 18:

Line 9, "An information processing apparatus" should read --A recording head--.

UNITED STATES PATENT AND TRADEMARK OFFICE

CERTIFICATE OF CORRECTION

PATENT NO. : 5,784,082 Page 3 of 4

DATED : July 21, 1998

INVENTOR(S) : SHINMACHI ET AL.

It is certified that error appears in the above-indentified patent and that said Letters Patent is hereby corrected as shown below:

Line 10, "the" should read --an--.

Line 13, "An information processing apparatus" should read --A recording head--.

Line 14, "the" should read --an--.

Line 17, "An information processing apparatus" should read --A recording head--.

Line 18, "the" should read --an--.

Line 22, "An information processing apparatus" should read --A recording head--.

Line 25, "An information processing apparatus" should read --A recording head--.

Line 26, "wherein said recording head is provided with" should read --further comprising--.

Line 29, "An information processing apparatus" should read --A recording head--.

Line 30, "wherein said recording head is provided with" should read --further comprising--.

Line 34, "An information processing apparatus" should read --A recording head--.

UNITED STATES PATENT AND TRADEMARK OFFICE

CERTIFICATE OF CORRECTION

PATENT NO. : 5,784,082 Page 4 of 4

DATED : July 21, 1998

INVENTOR(S) : SHINMACHI ET AL.

It is certified that error appears in the above-indentified patent and that said Letters Patent is hereby corrected as shown below:

Line 36, "the" (first occurrence) should be deleted.

Line 38, "An information processing apparatus" should read --A recording head--.

Line 40, "the" (first occurrence) should be deleted.

Line 41, "also," should be deleted.

Line 44, "An information processing apparatus" should read --A recording head--.

Line 45, "wherein said recording head is provided with" should read --further comprising--.

Signed and Sealed this

Eleventh Day of May, 1999

*Attest:*

Q. TODD DICKINSON

*Attesting Officer*

*Acting Commissioner of Patents and Trademarks*